US008366568B2

(12) United States Patent
Nakamura et al.

(10) Patent No.: US 8,366,568 B2
(45) Date of Patent: Feb. 5, 2013

(54) GOLF BALL

(75) Inventors: Hirotaka Nakamura, Kobe (JP); Keiji Ohama, Kobe (JP); Kazuhiko Isoagawa, Kobe (JP); Satoko Okabe, Kobe (JP)

(73) Assignee: SRI Sports Limited, Kobe (JP)

( * ) Notice: Subject to any disclaimer, the term of this patent is extended or adjusted under 35 U.S.C. 154(b) by 593 days.

(21) Appl. No.: 12/619,991

(22) Filed: Nov. 17, 2009

(65) Prior Publication Data

US 2010/0160087 A1 Jun. 24, 2010

(30) Foreign Application Priority Data

Dec. 24, 2008 (JP) ..... 2008-326780
Dec. 24, 2008 (JP) ..... 2008-327140

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 5,688,869 | A | 11/1997 | Sullivan | |
| 5,725,442 | A | 3/1998 | Higuchi et al. | |
| 5,977,264 | A | 11/1999 | Ichikawa et al. | |
| 5,997,416 | A | 12/1999 | Maruko | |
| 6,042,488 | A | 3/2000 | Sullivan et al. | |
| 6,182,970 | B1 | 2/2001 | Fuchihara et al. | |
| 2003/0008975 | A1 | 1/2003 | Takesue et al. | |
| 2006/0293121 | A1 | 12/2006 | Egashira et al. | |
| 2008/0146376 | A1 | 6/2008 | Watanabe | |
| 2008/0274834 | A1 * | 11/2008 | Comeau et al. | 473/374 |

FOREIGN PATENT DOCUMENTS

| | | | |
|---|---|---|---|
| JP | 11-417 | A | 1/1999 |
| JP | 11-70189 | A | 3/1999 |
| JP | 11-76464 | A | 3/1999 |
| JP | 2001-514561 | A | 9/2001 |
| JP | 2004-209071 | A | 7/2004 |
| JP | 2006-192268 | A | 7/2006 |
| JP | 2008-149131 | A | 7/2008 |
| WO | WO-98/40127 | A1 | 9/1998 |

* cited by examiner

*Primary Examiner* — Raeann Gorden
(74) *Attorney, Agent, or Firm* — Birch, Stewart, Kolasch & Birch, LLP

(57) ABSTRACT

A golf ball 2 includes a spherical core 4, a mid layer 6 positioned outside the core 4, and a cover 8 positioned outside the mid layer 6. The core 4 includes a spherical center 10 and an envelope layer 12 positioned outside the center 10. The center 10 has a diameter of 1 mm or greater and 15 mm or less. The center 10 has a JIS-C hardness H1, at its central point, of 20 or greater and 50 or less. The difference (H4−H3) between the JIS-C hardness H4 of the core 4 at its surface and the JIS-C hardness H3 of the envelope layer 12 at its innermost portion is equal to or greater than 10. The cover 8 has a flexural modulus of 300 MPa or greater and 1000 MPa or less, and has a tensile modulus of 400 MPa or greater and 1500 MPa or less.

11 Claims, 3 Drawing Sheets

GOLF BALL

This application claims priority on Patent Application No. 2008-326780 filed in JAPAN on Dec. 24, 2008 and Patent Application No. 2008-327140 filed in JAPAN on Dec. 24, 2008. The entire contents of these Japanese Patent Applications are hereby incorporated by reference.

BACKGROUND OF THE INVENTION

1. Field of the Invention

The present invention relates to golf balls. Specifically, the present invention relates to multi-piece golf balls including a center, an envelope layer, and a cover.

2. Description of the Related Art

Golf players' foremost requirement for golf balls is flight performance. Golf players place importance on flight performance with a driver, a long iron, and a middle iron. Flight performance correlates with the resilience performance of a golf ball. When a golf ball with excellent resilience performance is hit, the golf ball flies at a high speed, thereby achieving a long flight distance. Flight performance also correlates with a spin rate. Flight at a low spin rate results in a proper trajectory, thereby achieving a long flight distance. In light of flight performance, a golf ball with high resilience performance and to which spin is difficult to impart, is desired. Golf players also place importance on feel at impact of golf balls. Golf players prefer soft feel at impact.

There is a golf ball having an outer-hard/inner-soft structure. The launch angle of the golf ball is high when the golf ball is hit with a golf club. The spin rate of the golf ball is low when the golf ball is hit with a golf club. The high launch angle and the low spin rate can achieve a long flight distance.

A golf ball having a flexible center can have an outer-hard/inner-soft structure. Use of a cover with a high rigidity can also achieve the outer-hard/inner-soft structure. Use of an ionomer resin having a high acid content or an ionomer resin having a high degree of neutralization for a cover can achieve a cover with a high rigidity.

There is a golf ball having a hollow core. The golf ball has an ultimate inner-soft structure. The moment of inertia of the golf ball is great. The ultimate inner-soft structure and the great moment of inertia can suppress spin of the golf ball.

Use of a cover with a high rigidity can also achieve an outer-hard/inner-soft structure. Use of an ionomer resin having a high acid content or an ionomer resin having a high degree of neutralization for a cover can achieve a cover with a high rigidity.

U.S. Pat. No. 5,688,869 (JP-H06-80718) discloses a resin composition used for a cover of a golf ball. The resin composition includes an ionomer resin having a high acid content.

U.S. Pat. No. 6,042,488 (JP-H09-10357) discloses a golf ball that includes a core, an inner cover, and an outer cover. The outer cover is formed from a resin composition. The resin composition includes an ionomer resin having a high acid content.

U.S. Pat. No. 5,725,442 (JP-H09-56848) discloses a golf ball that includes a core, a mid layer, and a cover. The core has a two-layer structure. The principal component of the mid layer is a polyester, and the principal component of the cover is an ionomer resin. The hardness of the cover is great.

U.S. Pat. No. 5,977,264 (JP-H10-127822) discloses a golf ball that includes a core, a mid layer, and a cover. The cover is formed from a resin composition. The base material of the resin composition is an ionomer resin that includes a diamine complex.

US2003/008975 (JP-H10-314341) discloses a resin composition used for a cover of a golf ball. The resin composition includes an ionomer resin and a rubber-like functionalized copolymer.

U.S. Pat. No. 6,182,970 (JP-H11-128399) discloses a golf ball that includes a core and a cover. The core is hollow.

WO98/40127 (JP-2001-514561) discloses a golf ball that includes a core, a mid layer, and a cover. The cover is formed from a resin composition. The resin composition includes an ionomer resin and a polyamide.

US2006/293121 (JP-2007-622) discloses a resin composition used for a cover of a golf ball. The resin composition includes an ionomer resin, a thermoplastic resin, and a thermoplastic resin having an acid group.

In a golf ball having an outer-hard/inner-soft structure due to a flexible center, the hardness distribution from the surface of a mid layer to the central point of the center has a large step at the boundary between the center and the mid layer. The step impairs suppression of spin. The flexible center impairs resilience.

In a conventional golf ball having a hollow structure, a layer that surrounds an inner space is hard. The hardness at the inner space is zero. In the golf ball, the hardness difference between the inner space and the part that surrounds the inner space is great. When the golf ball is hit, the part that surrounds the inner space deforms greatly. Excessive spin occurs because the recoil (torsional return) of the part is small. The hollow part cannot contribute to resilience performance. The flight performance of the golf ball is insufficient.

In a golf ball having an outer-hard/inner-soft structure due to a cover with a high rigidity, the cover impairs feel at impact. A cover with a high rigidity due to an ionomer resin with a high acid content has inferior durability. A cover having a high rigidity due to an ionomer resin with a high degree of neutralization has inferior moldability.

Golf players' requirements for golf balls have been escalated more than ever. An objective of the present invention is to provide a golf ball having excellent flight performance and excellent durability.

SUMMARY OF THE INVENTION

A golf ball according to the present invention comprises a core and a cover positioned outside the core. The core includes a center and an envelope layer positioned outside the center. The center has a diameter of 1 mm or greater and 15 mm or less. The center has a JIS-C hardness H1, at its central point, of 20 or greater and 50 or less. A difference (H4−H3) between a JIS-C hardness H4 of the core at its surface and a JIS-C hardness H3 of the envelope layer at its innermost portion is equal to or greater than 10. The cover has a flexural modulus of 300 MPa or greater and 1000 MPa or less. The cover has a tensile modulus of 400 MPa or greater and 1500 MPa or less. Preferably, the cover has a Shore D hardness H6 of 65 or greater and 75 or less.

In the golf ball according to the present invention, the center with the low hardness H1 at its central point and the cover with a high rigidity achieve an outer-hard/inner-soft structure. In the golf ball, the diameter of the center is small, and the hardness difference (H4−H3) of the envelope layer is great. Thus, the step of hardness at the boundary between the center and the envelope layer is small. While a conventional golf ball has an outer-hard/inner-soft structure with a hardness distribution having inferior continuity, the golf ball according to the present invention has an outer-hard/inner-soft structure with a hardness distribution having excellent continuity. In the golf ball, spin is sufficiently suppressed.

Because the diameter of the center is small, the center does not impair the resilience performance of the golf ball. Because the cover has a high rigidity, the golf ball has excellent resilience performance even when the center is flexible.

The cover is formed from a resin composition. Preferably, the resin composition includes:

(A) a highly elastic polyamide resin with a flexural modulus of 700 MPa or greater and 5000 MPa or less;

(B) an ethylene-(meth)acrylic acid copolymer that is neutralized with a metal ion; and (C) a resin having a polar functional group.

The weight ratio of the polyamide resin (A) with respect to the copolymer (B) is equal to or greater than 5/95 and equal to or less than 80/20. The amount of the resin (C) is equal to or greater than 0.1 part by weight and equal to or less than 20 parts by weight, per total 100 parts by weight of the polyamide resin (A) and the copolymer (B).

Preferably, the polyamide resin (A) includes one or more members selected from the group consisting of polyamide 6, polyamide 11, polyamide 12, polyamide 66, polyamide 610, polyamide 6T, polyamide 6I, polyamide 9T, polyamide M5T, polyamide 612, and a polyether block amide copolymer.

Preferably, the copolymer (B) includes an ethylene-(meth) acrylic acid binary copolymer and/or an ethylene-(meth) acrylic acid-(meth)acrylic acid ester ternary copolymer.

Preferably, the resin (C) includes one or more members selected from the group consisting of an ethylene-glycidyl methacrylate copolymer, an ethylene-acrylic acid-glycidyl methacrylate copolymer, and a methyl methacrylate-glycidyl methacrylate copolymer.

The golf ball may further comprise a mid layer positioned between the core and the cover. Preferably, the hardness H6 of the cover is greater than a Shore D hardness H5 of the mid layer. Preferably, the mid layer is formed from a thermoplastic resin composition.

Preferably, a difference (H3−H2) between the hardness H3 and the JIS-C hardness H2 of the center at its surface is equal to or less than 35. Preferably, a difference (H4−H1) between the hardness H4 and the hardness H1 is equal to or greater than 40.

The center can be formed by crosslinking a rubber composition. Preferably, the principal component of the base rubber of the rubber composition is a polybutadiene. Preferably, the rubber composition includes sulfur as a crosslinking agent. The envelope layer can be formed by crosslinking a rubber composition. Preferably, the principal component of the base rubber of the rubber composition of the envelope layer is a polybutadiene.

According to another aspect of the present invention, a golf ball comprises a core and a cover positioned outside the core. The core includes a hollow center and an envelope layer positioned outside the center. The center has an inner diameter of 2 mm or greater and 13 mm or less. The center has an outer diameter of 5 mm or greater and 15 mm or less. The center has a JIS-C hardness H2, at its surface, of 25 or greater and 55 or less. The difference (H4−H3) between the JIS-C hardness H4 of the core at its surface and the JIS-C hardness H3 of the envelope layer at its innermost portion is equal to or greater than 10. The cover has a flexural modulus of 300 MPa or greater and 1000 MPa or less. The cover has a tensile modulus of 400 MPa or greater and 1500 MPa or less. Preferably, the cover has a Shore D hardness H6 of 65 or greater and 75 or less.

In the golf ball, the hollow center and the highly elastic cover achieve an outer-hard/inner-soft structure. Because the center is flexible, the hardness difference between the inner space and a part that surrounds the inner space is small. In the golf ball, the diameter of the center is small, and the hardness difference (H4−H3) of the envelope layer is great. Thus, the step of hardness at the boundary between the center and the envelope layer is small. While a conventional golf ball has an outer-hard/inner-soft structure with a hardness distribution having inferior continuity, the golf ball according to the present invention has an outer-hard/inner-soft structure with a hardness distribution having excellent continuity. In the golf ball, spin is sufficiently suppressed. Because the highly elastic cover is used, the resilience coefficient of the golf ball is great even though the center is hollow. The golf ball has excellent flight performance.

The cover is formed from a resin composition. Preferably, the resin composition includes:

(A) a highly elastic polyamide resin with a flexural modulus of 700 MPa or greater and 5000 MPa or less;

(B) an ethylene-(meth)acrylic acid copolymer that is neutralized with a metal ion; and (C) a resin having a polar functional group.

The weight ratio of the polyamide resin (A) with respect to the copolymer (B) is equal to or greater than 5/95 and equal to or less than 80/20. The amount of the resin (C) is equal to or greater than 0.1 part by weight and equal to or less than 20 parts by weight, per total 100 parts by weight of the polyamide resin (A) and the copolymer (B).

Preferably, the polyamide resin (A) includes one or more members selected from the group consisting of polyamide 6, polyamide 11, polyamide 12, polyamide 66, polyamide 610, polyamide 6T, polyamide 6I, polyamide 9T, polyamide M5T, polyamide 612, and a polyether block amide copolymer.

Preferably, the copolymer (B) includes an ethylene-(meth) acrylic acid binary copolymer and/or an ethylene-(meth) acrylic acid-(meth)acrylic acid ester ternary copolymer.

Preferably, the resin (C) includes one or more members selected from the group consisting of an ethylene-glycidyl methacrylate copolymer, an ethylene-acrylic acid-glycidyl methacrylate copolymer, and a methyl methacrylate-glycidyl methacrylate copolymer.

The golf ball may further comprise a mid layer positioned between the core and the cover. Preferably, the hardness H6 of the cover is greater than the Shore D hardness H5 of the mid layer. Preferably, the mid layer is formed from a thermoplastic resin composition.

Preferably, the center has a JIS-C hardness H1, at its innermost portion, of 35 or less. Preferably, the difference (H3−H2) between the hardness H3 and the hardness H2 is equal to or less than 35. Preferably, the difference (H4−H2) between the hardness H4 and the hardness H2 is equal to or greater than 40.

The center can be formed by crosslinking a rubber composition. Preferably, the rubber composition includes sulfur as a crosslinking agent. Preferably, the rubber composition includes a natural rubber.

The envelope layer can be formed by crosslinking a rubber composition. Preferably, the principal component of the base rubber of the rubber composition is a polybutadiene.

DESCRIPTION OF THE PREFERRED EMBODIMENTS

The following will describe in detail the present invention based on preferred embodiments with reference to the accompanying drawings.

Figure 1:
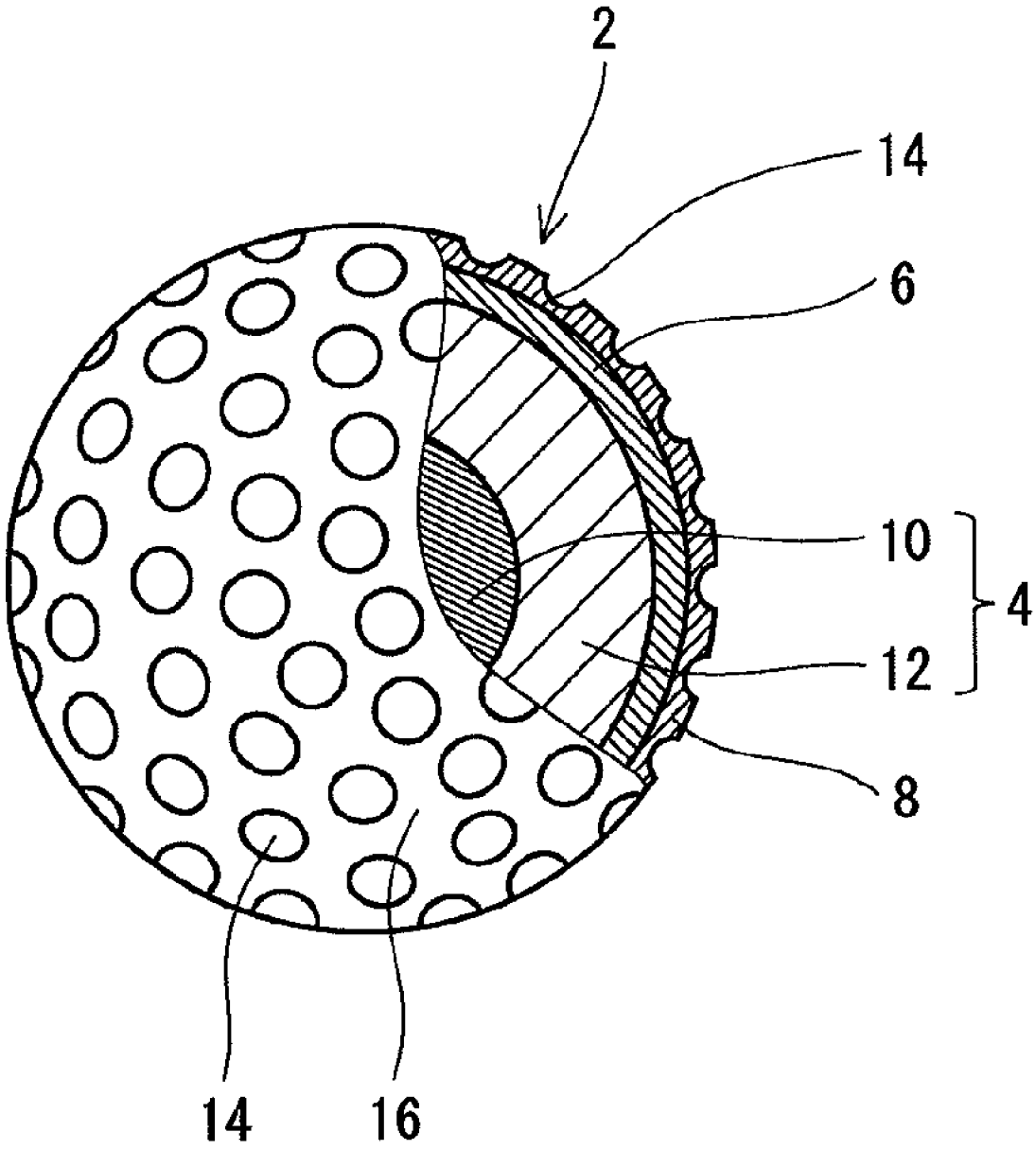
FIG. 1 is a partially cutaway plan view of a golf ball according to an embodiment of the present invention, showing a cross section of the golf ball.

Golf ball 2 shown in FIG. 1 includes a spherical core 4, a mid layer 6 positioned outside the core 4, and a cover 8 positioned outside the mid layer 6. The core 4 includes a spherical center 10 and an envelope layer 12 positioned outside the center 10. On the surface of the cover 8, a large number of dimples 14 are formed. Of the surface of the golf ball 2, a part other than the dimples 14 is a land 16. The golf ball 2 includes a paint layer and a mark layer on the external side of the cover 8 although these layers are not shown in the drawing.

The golf ball 2 has a diameter of 40 mm or greater and 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater and 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

The center 10 is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and particularly preferably equal to or greater than 80% by weight. The proportion of cis-1,4 bonds in the polybutadiene is preferably equal to or greater than 40% and particularly preferably equal to or greater than 80%.

Crosslinking with sulfur, crosslinking with a peroxide, crosslinking with an electronic ray, and the like can be used for the center 10. Crosslinking with sulfur is preferred. The center 10 obtained by crosslinking with sulfur is flexible. The center 10 achieves an outer-hard/inner-soft structure of the core 4. The core 4 suppresses spin. The core 4 also contributes to feel at impact.

In light of resilience performance of the golf ball 2, the amount of the sulfur is preferably equal to or greater than 2.0 parts by weight and particularly preferably equal to or greater than 3.0 parts by weight, per 100 parts by weight of the base rubber. In light of flexibility of the center 10, the amount of the sulfur is preferably equal to or less than 10.0 parts by weight and particularly preferably equal to or less than 6.5 parts by weight, per 100 parts by weight of the base rubber.

When crosslinking with sulfur is used, the rubber composition of the center 10 preferably includes a vulcanization accelerator. The vulcanization accelerator achieves a short time period for crosslinking the center 10. Guanidine type vulcanization accelerators, thiazole type vulcanization accelerators, sulfenamide type vulcanization accelerators, aldehyde-ammonia type vulcanization accelerators, thiourea type vulcanization accelerators, thiuram type vulcanization accelerators, dithiocarbamate type vulcanization accelerators, xanthate type vulcanization accelerators, and the like can be used. Guanidine type vulcanization accelerators, thiazole type vulcanization accelerators, and sulfenamide type vulcanization accelerators are preferred. Two or more types of vulcanization accelerators may be used in combination.

Examples of guanidine type vulcanization accelerators include 1,3-diphenylguanidine, 1,3-di-o-tolylguanidine, 1-o-tolylbiguanide, and the di-o-tolylguanidine salt of dicatechol borate. Specific examples of 1,3-diphenylguanidine include trade names "Nocceler D" and "Nocceler D-P" available from Ouchi Shinko Chemical Industrial Co., Ltd., and trade names "Soxinol D", "Soxinol DG", and "Soxinol DO", available from Sumitomo Chemical Co., Ltd. Specific examples of 1,3-di-o-tolylguanidine include trade name "Nocceler DT" available from Ouchi Shinko Chemical Industrial Co., Ltd., and trade names "Soxinol DT" and "Soxinol DT-O" available from Sumitomo Chemical Co., Ltd. One specific example of 1-o-tolylbiguanide is trade name "Nocceler BG" available from Ouchi Shinko Chemical Industrial Co., Ltd. One specific example of the di-o-tolylguanidine salt of dicatechol borate is trade name "Nocceler PR" available from Ouchi Shinko Chemical Industrial Co., Ltd.

Examples of thiazole type vulcanization accelerators include 2-mercaptobenzothiazole, di-2-benzothiazolyl disulfide, 2-mercaptobenzothiazole zinc salt, 2-mercaptobenzothiazole cyclohexylamine salt, 2-(N,N-diethylthiocarbamoylthio)benzothiazole, and 2-(4'-morpholinodithio) benzothiazole. Specific examples of 2-mercaptobenzothiazole include trade names "Nocceler M" and "Nocceler M-P" available from Ouchi Shinko Chemical Industrial Co., Ltd. Specific examples of di-2-benzothiazolyl disulfide include trade names "Nocceler DM" and "Nocceler DM-P" available from Ouchi Shinko Chemical Industrial Co., Ltd. One specific example of 2-mercaptobenzothiazol zinc salt is trade name "Nocceler MZ" available from Ouchi Shinko Chemical Industrial Co., Ltd. One specific example of 2-mercaptobenzothiazole cyclohexylamine salt is trade name "Nocceler M-60-OT" available from Ouchi Shinko Chemical Industrial Co., Ltd. One specific example of 2-(N,N-diethylthiocarbamoylthio)benzothiazole is trade name "Nocceler 64" available from Ouchi Shinko Chemical Industrial Co., Ltd. Specific examples of 2-(4'-morpholinodithio)benzothiazole include trade names "Nocceler MDB" and "Nocceler MDB-P" available from Ouchi Shinko Chemical Industrial Co., Ltd.

Examples of sulfenamide type vulcanization accelerators include N-cyclohexyl-2-benzothiazolyl sulfenamide, N-tert-butyl-2-benzothiazolyl sulfenamide, N-oxydiethylene-2-benzothiazolyl sulfenamide, and N,N'-dicyclohexyl-2-benzothiazolyl sulfenamide. Specific examples of N-cyclohexyl-2-benzothiazolyl sulfenamide include trade names "Nocceler CZ" and "Nocceler CZ-G" available from Ouchi Shinko Chemical Industrial Co., Ltd. Specific examples of N-tert-butyl-2-benzothiazolyl sulfenamide include trade names "Nocceler NS" and "Nocceler NS-P" available from Ouchi Shinko Chemical Industrial Co., Ltd. One specific example of N-oxydiethylene-2-benzothiazolyl sulfenamide is trade name "Nocceler MSA-G" available from Ouchi Shinko Chemical Industrial Co., Ltd. Specific examples of N,N'-dicyclohexyl-2-benzothiazolyl sulfenamide include trade names "Nocceler DZ" and "Nocceler DZ-G" available from Ouchi Shinko Chemical Industrial Co., Ltd.

The amount of the vulcanization accelerator is preferably equal to or greater than 0.5 part by weight and particularly preferably equal to or greater than 2.0 parts by weight, per 100 parts by weight of the base rubber. The amount of the vulcanization accelerator is preferably equal to or less than 7.0 parts by weight and particularly preferably equal to or less than 5.0 parts by weight, per 100 parts by weight of the base rubber.

When crosslinking with sulfur is used, the center 10 preferably includes a reinforcing agent. A preferable reinforcing agent is silica (white carbon). The silica can achieve a proper rigidity of the center 10. Dry-process silica and wet-process silica can be used. In light of rigidity of the center 10, the amount of the silica is preferably equal to or greater than 5 parts by weight and particularly preferably equal to or greater than 7 parts by weight, per 100 parts by weight of the base rubber. In light of flexibility of the center 10, the amount of the silica is preferably equal to or less than 25 parts by weight and particularly preferably equal to or less than 15 parts by weight, per 100 parts by weight of the base rubber. A silane coupling agent may be included together with silica.

The center 10 may be crosslinked with a co-crosslinking agent and an organic peroxide. By using a small amount of a co-crosslinking agent as compared with that in a general golf ball, a flexible center 10 is obtained. As described later, a special resin composition is used for the cover 8 of the golf ball 2. Even when the amount of the co-crosslinking agent is small, the golf ball 2 with excellent durability can be obtained by using the co-crosslinking agent in combination with an organic peroxide and using a special resin composition for the cover 8.

Examples of preferable co-crosslinking agents include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 1 part by weight and particularly preferably equal to or greater than 2 parts by weight, per 100 parts by weight of the base rubber. In light of flexibility of the center 10, the amount of the co-crosslinking agent is preferably equal to or less than 14 parts by weight, more preferably equal to or less than 12 parts by weight, and particularly preferably equal to or less than 10 parts by weight, per 100 parts by weight of the base rubber.

Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 2.5 parts by weight, more preferably equal to or less than 2.0 parts by weight, and particularly preferably equal to or less than 1.5 parts by weight, per 100 parts by weight of the base rubber.

The rubber composition of the center 10 may include an organic sulfur compound together with a co-crosslinking agent and an organic peroxide. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl)disulfide; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; trisubstitutions such as bis(2,4,6-trichlorophenyl)disulfide and bis(2-cyano-4-chloro-6-bromophenyl)disulfide; tetrasubstitutions such as bis(2,3,5,6-tetrachlorophenyl)disulfide; and pentasubstitutions such as bis(2,3,4,5,6-pentachlorophenyl)disulfide and bis(2,3,4,5,6-pentabromophenyl)disulfide. The organic sulfur compound contributes to resilience performance. Particularly preferable organic sulfur compounds are diphenyl disulfide and bis(pentabromophenyl)disulfide.

In light of resilience performance of the golf ball 2, the amount of the organic sulfur compound is preferably equal to or greater than 0.1 part by weight and particularly preferably equal to or greater than 0.2 part by weight, per 100 parts by weight of the base rubber. In light of soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the center 10. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the center 10 is accomplished. A particularly preferable filler is zinc oxide. Zinc oxide serves not only as a specific gravity adjuster but also as a crosslinking activator.

According to need, various additives such as an anti-aging agent, a coloring agent, a plasticizer, a dispersant, and the like are included in the center 10 in an adequate amount. Crosslinked rubber powder or synthetic resin powder may be also included in the center 10.

In light of durability, the center 10 has a central hardness H1 of preferably 20 or greater, more preferably 25 or greater, and particularly preferably 30 or greater. In light of suppression of spin, the central hardness H1 is preferably equal to or less than 50, more preferably equal to or less than 45, and particularly preferably equal to or less than 40. The central hardness H1 is measured by pressing a JIS-C type hardness scale against the central point of a cut plane of the center 10 that has been cut into two halves. For the measurement, an automated rubber hardness measurement machine (trade name "P1", available from Kobunshi Keiki Co., Ltd.), to which this hardness scale is mounted, is used.

The hardness of the center 10 gradually increases from its central point toward its surface. The center 10 has a surface hardness H2 greater than the central hardness H1. The great surface hardness H2 can achieve continuity of hardness between the center 10 and the envelope layer 12. In this respect, the surface hardness H2 of the center 10 is preferably equal to or greater than 25 and particularly preferably equal to or greater than 30. In light of feel at impact, the surface hardness H2 is preferably equal to or less than 60, more preferably equal to or less than 50, and particularly preferably equal to or less than 40. The surface hardness H2 is measured by pressing a JIS-C type hardness scale against the surface of the center 10. For the measurement, an automated rubber hardness measurement machine (trade name "P1", available from Kobunshi Keiki Co., Ltd.), to which this hardness scale is mounted, is used.

In light of feel at impact, a difference (H2−H1) between the surface hardness H2 and the central hardness H1 is preferably equal to or greater than 1 and particularly preferably equal to or greater than 2. In light of resilience performance, the difference (H2−H1) is preferably equal to or less than 15, more preferably equal to or less than 10, and particularly preferably equal to or less than 5.

In light of feel at impact, the center 10 has an amount of compressive deformation D1 of preferably 0.5 mm or greater, more preferably 1.0 mm or greater, and particularly preferably 1.1 mm or greater. In light of resilience performance, an amount of compressive deformation D1 is preferably equal to or less than 2.5 mm, more preferably equal to or less than 2.3 mm, and particularly preferably equal to or less than 2.0 mm.

Upon measurement of the amount of compressive deformation, first, a sphere is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load is applied to the sphere up to the state in which a final load is applied thereto, is the amount of compressive deformation. In measuring the amount of compressive deformation D1 of the center 10, the initial load is 0.3 N and the final load is 29.4 N. In measuring the amount of compressive deformation D2 of the core 4, the amount of compressive deformation D3 of a sphere consisting of the core 4 and the mid layer 6, and the amount of compressive deformation D4 of the golf ball 2, the initial load is 98 N and the final load is 1274 N.

The center 10 has a diameter smaller than that of the center of a general golf ball. Due to the small center 10, the envelope layer 12 can be formed with a sufficient thickness. The envelope layer 12 can achieve an outer-hard/inner-soft structure with a hardness distribution having excellent continuity. The small center 10 suppresses spin. Even if being flexible, the small center 10 does not impair the resilience performance of the golf ball 2. In light of continuity of the hardness distribution and resilience performance, the diameter of the center 10 is preferably equal to or less than 15 mm, more preferably equal to or less than 14 mm, and particularly preferably equal to or less than 10 mm. From the standpoint that the center 10 can contribute to suppression of spin, the diameter is preferably equal to or greater than 2 mm, more preferably equal to or greater than 4 mm, and particularly preferably equal to or greater than 5 mm.

The center 10 has a weight of preferably 0.05 g or greater and 3 g or less. The temperature for crosslinking the center 10 is generally equal to or higher than 140° C. and equal to or lower than 180° C. The time period for crosslinking the center 10 is generally equal to or longer than 3 minutes and equal to or shorter than 30 minutes. The center 10 may be formed with two or more layers. The center 10 may have a rib on its surface.

The envelope layer 12 is obtained by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and particularly preferably equal to or greater than 80% by weight. The proportion of cis-1,4 bonds in the polybutadiene is preferably equal to or greater than 40% and particularly preferably equal to or greater than 80%.

In order to crosslink the envelope layer 12, a co-crosslinking agent is preferably used. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 10 parts by weight and particularly preferably equal to or greater than 15 parts by weight, per 100 parts by weight of the base rubber. In light of soft feel at impact, the amount of the co-crosslinking agent is preferably equal to or less than 50 parts by weight and particularly preferably equal to or less than 45 parts by weight, per 100 parts by weight of the base rubber.

Preferably, the rubber composition of the envelope layer 12 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy) hexane, and di-t-butyl peroxide. In light of versatility, dicumyl peroxide is preferred.

In light of resilience performance of the golf ball 2, the amount of the organic peroxide is preferably equal to or greater than 0.1 part by weight, more preferably equal to or greater than 0.3 part by weight, and particularly preferably equal to or greater than 0.5 part by weight, per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight, per 100 parts by weight of the base rubber.

Preferably, the rubber composition of the envelope layer 12 includes an organic sulfur compound. The organic sulfur compounds described above for the center 10 can be used for the envelope layer 12. In light of resilience performance of the golf ball 2, the amount of the organic sulfur compound is preferably equal to or greater than 0.1 part by weight and particularly preferably equal to or greater than 0.2 part by weight, per 100 parts by weight of the base rubber. In light of soft feel at impact, the amount of the organic sulfur compound is preferably equal to or less than 1.5 parts by weight, more preferably equal to or less than 1.0 part by weight, and particularly preferably equal to or less than 0.8 part by weight, per 100 parts by weight of the base rubber.

For the purpose of adjusting specific gravity and the like, a filler may be included in the envelope layer 12. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the envelope layer 12 is accomplished. A particularly preferable filler is zinc oxide. Zinc oxide serves not only as a specific gravity adjuster but also as a crosslinking activator.

According to need, various additives such as sulfur, an anti-aging agent, a coloring agent, a plasticizer, a dispersant, and the like are included in the envelope layer 12 in an adequate amount. Crosslinked rubber powder or synthetic resin powder may be also included in the envelope layer 12.

The hardness of the envelope layer 12 gradually increases from its innermost portion to its surface (i.e., the surface of the core 4). The envelope layer 12 has a low hardness H3 at its innermost portion and a great hardness H4 at its surface. The low hardness H3 can achieve the continuity of hardness between the center 10 and the envelope layer 12. The great hardness H4 achieves the outer-hard/inner-soft structure of the core 4. The envelope layer 12 sufficiently suppresses spin.

In light of resilience performance, the innermost portion hardness H3 is preferably equal to or greater than 45, more preferably equal to or greater than 55, and particularly preferably equal to or greater than 63. In light of continuity of the hardness distribution, the innermost portion hardness H3 is preferably equal to or less than 75, more preferably equal to or less than 70, and particularly preferably equal to or less than 67. The hardness H3 is measured for a hemisphere obtained by cutting the core 4. The hardness H3 is measured by pressing a JIS-C type hardness scale against the cut plane of the hemisphere. The hardness scale is pressed against a region surrounded by: a first circle that is the boundary between the center 10 and the envelope layer 12; and a second circle that is concentric with the first circle and has a radius larger than the radius of the first circle by 1 mm. For the measurement, an automated rubber hardness measurement machine (trade name "P1", available from Kobunshi Keiki Co., Ltd.), to which this hardness scale is mounted, is used.

In light of achievement of the outer-hard/inner-soft structure, the surface hardness H4 of the core 4 is preferably equal to or greater than 65, more preferably equal to or greater than 75, and particularly preferably equal to or greater than 79. In light of feel at impact, the hardness H4 is preferably equal to or less than 90 and particularly preferably equal to or less than 85. The hardness H4 is measured by pressing a JIS-C type hardness scale against the surface of the core 4 (i.e., the surface of the envelope layer 12). For the measurement, an automated rubber hardness measurement machine (trade name "P1", available from Kobunshi Keiki Co., Ltd.), to which this hardness scale is mounted, is used.

In light of suppression of spin, a difference (H4−H3) between the surface hardness H4 of the core 4 and the innermost portion hardness H3 of the envelope layer 12 is preferably equal to or greater than 10, more preferably equal to or greater than 13, and particularly preferably equal to or greater than 14. In light of ease of production, the difference (H4−H3) is preferably equal to or less than 25, more preferably equal to or less than 20, and particularly preferably equal to or less than 16.

In light of achievement of a great difference (H4−H3), the envelope layer 12 has a thickness of preferably 10 mm or greater, more preferably 11 mm or greater, and particularly preferably 12 mm or greater. The thickness is preferably equal to or less than 20 mm.

The envelope layer 12 has a weight of preferably 30 g or greater and 44 g or less. The temperature for crosslinking the envelope layer 12 is generally equal to or higher than 140° C. and equal to or lower than 180° C. The time period for crosslinking the envelope layer 12 is generally equal to or longer than 10 minutes and equal to or shorter than 60 minutes. The envelope layer 12 may have a rib on its surface.

In light of continuity of the hardness distribution, a difference (H3−H2) between the innermost portion hardness H3 of the envelope layer 12 and the surface hardness H2 of the center 10 is preferably equal to or less than 35 and particularly preferably equal to or less than 34. The difference (H3−H2) may be zero.

In light of suppression of spin, a difference (H4−H1) between the surface hardness H4 of the core 4 and the central hardness H1 of the center 10 is preferably equal to or greater than 40, more preferably equal to or greater than 43, and particularly preferably equal to or greater than 46. In light of ease of production, the difference (H4−H1) is preferably equal to or less than 65, more preferably equal to or less than 60, and particularly preferably equal to or less than 55.

In light of feel at impact, the core 4 has an amount of compressive deformation D2 of preferably 2.3 mm or greater, more preferably 2.4 mm or greater, and particularly preferably 2.5 mm or greater. In light of resilience performance, the amount of compressive deformation D2 is preferably equal to or less than 4.0 mm, more preferably equal to or less than 3.9 mm, and particularly preferably equal to or less than 3.8 mm.

In light of resilience performance, the core 4 has a diameter of preferably 28.0 mm or greater, more preferably 30.0 mm or greater, and particularly preferably 32.0 mm or greater. In light of durability of the golf ball 2, the diameter of the core 4 is preferably equal to or less than 40.2 mm, more preferably equal to or less than 39.9 mm, and particularly preferably equal to or less than 39.6 mm.

As described above, the golf ball 2 includes the mid layer 6 and the cover 8. The mid layer 6 is flexible, and the cover 8 is hard. The cover 8 achieves an outer-hard/inner-soft structure of the golf ball 2. In the golf ball 2, spin is suppressed. Further the cover 8 achieves excellent resilience performance of the golf ball 2. Because the mid layer 6 is flexible, the shock at impact can be absorbed. Even though the cover 8 is hard, the mid layer 6 achieves soft feel at impact of the golf ball 2.

A resin composition is suitably used for the mid layer 6. Examples of the base polymer of the resin composition include ionomer resins, styrene block-containing thermoplastic elastomers, thermoplastic polyester elastomers, thermoplastic polyamide elastomers, and thermoplastic polyolefin elastomers.

Particularly preferable base polymers are ionomer resins. Ionomer resins are highly elastic. The golf ball 2 in which an ionomer resin is used for the mid layer 6 has excellent resilience performance. An ionomer resin and another resin may be used in combination. In this case, in light of resilience performance, the proportion of the ionomer resin to the entire base polymer is preferably equal to or greater than 30% by weight, more preferably equal to or greater than 40% by weight, and particularly preferably equal to or greater than 45% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", available from Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", available from E.I. du Pont de Nemours and Company; and trade names "IOTEK 7010", "IOTEK 7030", "IOTEK 7510", "IOTEK 7520", "IOTEK 8000", and "IOTEK 8030", available from ExxonMobil Chemical Corporation.

Two or more types of ionomer resins may be used in combination for the mid layer 6. An ionomer resin neutralized with a monovalent metal ion, and an ionomer resin neutralized with a bivalent metal ion may be used in combination.

A preferable resin that can be used in combination with an ionomer resin is a styrene block-containing thermoplastic elastomer. This elastomer can contribute to the feel at impact of the golf ball 2. This elastomer does not impair the resilience performance of the golf ball 2. This elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more types selected from the group consisting of SBS, SIS, SIBS, SEBS, SEPS, SEEPS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", available from Mitsubishi Chemical Corporation. Other specific examples of styrene block-containing thermoplastic elastomers include trade name "Epofriend A1010" available from Daicel Chemical Industries, Ltd., and trade name "Septon HG-252" available from Kuraray Co., Ltd.

When an ionomer resin and a styrene block-containing thermoplastic elastomer are used in combination for the mid layer 6, the weight ratio of them is preferably equal to or greater than 30/70 and equal to or less than 95/5. The mid layer 6 in which the ratio is equal to or greater than 30/70 contributes to the resilience performance of the golf ball 2. In this respect, the ratio is more preferably equal to or greater than 40/60 and particularly preferably equal to or greater than 50/50. The mid layer 6 in which the ratio is equal to or less than 95/5 contributes to the feel at impact of the golf ball 2. In this respect, the ratio is more preferably equal to or less than 80/20 and particularly preferably equal to or less than 70/30.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the mid layer 6 in an adequate amount. For forming the mid layer 6, known methods such as injection molding, compression molding, and the like can be used.

In light of resilience performance, the mid layer 6 has a hardness H5 of preferably 20 or greater, more preferably 30 or greater, and particularly preferably 35 or greater. In light of feel at impact, the hardness H5 is preferably equal to or less than 55 and particularly preferably equal to or less than 50.

The hardness H5 is measured according to the standards of "ASTM-D 2240-68" with an automated rubber hardness measurement machine (trade name "P1", available from Kobunshi Keiki Co., Ltd.) to which a Shore D type spring hardness scale is mounted. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the mid layer 6 is used for the measurement.

In light of feel at impact of the golf ball 2, the mid layer 6 has a thickness of preferably 0.3 mm or greater, more preferably 0.5 mm or greater, and particularly preferably 0.7 mm or greater. In light of resilience performance of the golf ball 2, the thickness is preferably equal to or less than 2.5 mm, more preferably equal to or less than 2.0 mm, and particularly preferably equal to or less than 1.5 mm.

In light of feel at impact, the sphere consisting of the core 4 and the mid layer 6 has an amount of compressive deformation D3 of preferably 2.3 mm or greater, more preferably 2.8 mm or greater, and particularly preferably 3.2 mm or greater. In light of resilience performance, the amount of compressive deformation D3 is preferably equal to or less than 4.0 mm, more preferably equal to or less than 3.6 mm, and particularly preferably equal to or less than 3.4 mm.

The cover 8 is formed from a resin composition. The resin composition includes:

(A) a highly elastic polyamide resin with a flexural modulus of 700 MPa or greater and 5000 MPa or less;

(B) an ethylene-(meth)acrylic acid copolymer that is neutralized with a metal ion; and (C) a resin having a polar functional group.

The cover 8 that includes the polyamide resin (A) has a high rigidity. The cover 8 achieves an outer-hard/inner-soft structure of the golf ball 2. When the golf ball 2 having the outer-hard/inner-soft structure is hit with a driver, a high launch angle is obtained. When the golf ball 2 is hit with a driver, the golf ball 2 flies at a low spin rate. Due to the high launch angle and the low spin rate, a long flight distance is obtained. The polyamide resin (A) also contributes to the low-temperature durability of the golf ball 2.

The polyamide resin (A) is a resin or an elastomer which contains a polyamide. The polyamide is a polymer having a plurality of amide bonds (—NH—CO—) in the main chain thereof. Examples of the polyamide include aliphatic polyamides, aromatic polyamides, and amide copolymers. Examples of aliphatic polyamides include polyamide 6, polyamide 11, polyamide 12, polyamide 66, polyamide 610, polyamide 6T, polyamide 6I, polyamide 9T, polyamide M5T, and polyamide 612. Examples of aromatic polyamides include poly-p-phenylene terephthalamide and poly-m-phenylene isophthalamide. Examples of amide copolymers include polyether block amide copolymers, polyester amide copolymers, polyether ester amide copolymers, and polyamide imide copolymers. The polyamide resin (A) may contain two or more polyamides. Aliphatic polyamides and polyether block amide copolymers are preferred. Polyamide 6, polyamide 11, and polyamide 12 are particularly preferred.

The flexural modulus of the polyamide resin (A) is equal to or greater than 700 MPa and equal to or less than 5000 MPa. The polyamide resin (A) with a flexural modulus of 700 MPa or greater achieves a high rigidity of the cover 8. The cover 8 can suppress the spin upon a shot with a driver. In this respect, the flexural modulus is preferably equal to or greater than 750 MPa and particularly preferably equal to or greater than 800 MPa. The polyamide resin (A) with a flexural modulus of 5000 MPa or less does not impair the feel at impact and the durability of the golf ball 2. In this respect, the flexural modulus is preferably equal to or less than 4500 MPa and particularly preferably equal to or less than 4000 MPa.

For measuring the flexural modulus, a test piece, which has a length of 80.0±2 mm, a width of 10.0±0.2 mm, and a thickness of 4.0±0.2 mm, is used. The test piece is obtained by injection molding from dry pellets of the polyamide resin (A). The molded test piece is maintained in a moisture-proof container for 24 hours or longer at a temperature of 23° C.±2° C. Within 15 minutes after the test piece is taken out from the moisture-proof container, the flexural modulus is measured according to the standards of ISO178. The measurement is conducted in the environment of: a temperature of 23° C.; and a humidity of 50% RH.

The polyamide resin (A) has a brittle temperature of preferably −20° C. or lower. The polyamide resin (A) with a brittle temperature of −20° C. or lower contributes to the low-temperature durability of the golf ball 2. In this respect, the brittle temperature is more preferably equal to or lower than −30° C. and particularly preferably equal to or lower than −50° C. The brittle temperature is measured according to the standards of "JIS K 7216".

Specific examples of the highly elastic polyamide resin (A) include trade names "Novamid ST220", "Novamid 1010C2", and "Novamid ST145", available from Mitsubishi Engineering-Plastics Company; trade name "Pebax 7233SA" available from Arkema Inc.; trade names "UBE Nylon 1018I" and "UBE Nylon 1030J" available from Ube Industries, Ltd.; trade names "Zytel FN716" and "Zytel ST811HS" available from E.I. du Pont de Nemours and Company; trade names "Amilan U441", "Amilan U328", and "Amilan U141", available from Toray Industries Inc.; and trade name "Leona 1300S" available from Asahi Kasei Corporation.

The content of the polyamide resin (A) in the resin composition of the cover 8 is preferably equal to or greater than 5% by weight and equal to or less than 80% by weight. The cover 8 in which the content is equal to or greater than 5% by weight can achieve the outer-hard/inner-soft structure. In this respect, the content is more preferably equal to or greater than 13% by weight and particularly preferably equal to or greater than 15% by weight. The cover 8 in which the content is equal to or less than 80% by weight does not impair the durability and the feel at impact of the golf ball 2. In this respect, the content is more preferably equal to or less than 75% by weight and particularly preferably equal to or less than 70% by weight.

The ethylene-(meth)acrylic acid copolymer (B) that is neutralized with a metal ion contributes to the resilience performance of the golf ball 2. In addition, the copolymer (B) contributes to the fluidity of the resin composition of the cover 8. The cover 8 can easily be formed.

The copolymer (B) is obtained by a copolymerization reaction of a monomer composition that includes ethylene and (meth)acrylic acid. In the present specification, the term "(meth)acrylic acid" is intended to mean acrylic acid and/or methacrylic acid. The copolymer (B) may be obtained by a multi-copolymerization reaction of ethylene, (meth)acrylic acid, and another monomer. Examples of the other monomer include vinyl esters such as vinyl acetate and vinyl propionate; unsaturated carboxylate esters such as methyl(meth)acrylate, ethyl(meth)acrylate, isopropyl(meth)acrylate, isobutyl(meth)acrylate, n-butyl(meth)acrylate, isooctyl(meth)acrylate, 2-ethylhexyl(meth)acrylate, dimethyl maleate, and diethyl maleate; carbon monoxide; and sulfur dioxide. Typical copolymers are ethylene-(meth)acrylic acid binary copolymers and ethylene-(meth)acrylic acid-(meth)acrylic acid ester ternary copolymers. Two or more copolymers may be used in combination.

The content of the (meth)acrylic acid component in the copolymer (B) is preferably equal to or greater than 2% by weight and particularly preferably equal to or greater than 3% by weight. The content is preferably equal to or less than 30% by weight and particularly preferably equal to or less than 25% by weight.

In the copolymer (B), some of the carboxyl groups are neutralized with metal ions. For the neutralization, monovalent metal ions such as sodium ion, potassium ion, and lithium ion; bivalent metal ions such as magnesium ion, calcium ion, zinc ion, barium ion, and cadmium ion; and trivalent metal ions such as aluminum ion, can be used. In light of resilience performance and durability of the golf ball 2, sodium ion, zinc ion, and magnesium ion are preferred.

The degree of neutralization of the carboxyl groups in the copolymer (B) is preferably equal to or greater than 20 mol % and particularly preferably equal to or greater than 30 mol %. The degree of neutralization is preferably equal to or less than 90 mol % and particularly preferably equal to or less than 85 mol %. The degree of neutralization is the proportion of the number of moles of neutralized carboxyl groups to the total number of moles of the carboxyl groups.

The copolymer (B) has a flexural modulus of preferably 250 MPa or greater and 1000 MPa or less. The copolymer (B)

with a flexural modulus of 250 MPa or greater achieves a high rigidity of the cover 8. The cover 8 can suppress the spin upon a shot with a driver. In this respect, the flexural modulus is preferably equal to or greater than 260 MPa and particularly preferably equal to or greater than 270 MPa. The copolymer (B) with a flexural modulus of 1000 MPa or less does not impair the feel at impact and the durability of the golf ball 2. In this respect, the flexural modulus is preferably equal to or less than 800 MPa and particularly preferably equal to or less than 600 MPa.

Specific examples of the copolymer (B) include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan MK7320", and "Himilan MK7329", available from Du Pont-MITSUI POLYCHEMICALS Co., Ltd.; trade names "Surlyn 6120", "Surlyn 6320", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", available from E.I. du Pont de Nemours and Company; and trade names "IOTEK 7010", "IOTEK 7030", "IOTEK 7510", "IOTEK 7520", "IOTEK 8000", and "IOTEK 8030", available from ExxonMobil Chemical Corporation. Two or more types of resins may be used in combination.

The content of the copolymer (B) in the resin composition of the cover 8 is preferably equal to or greater than 15% by weight and equal to or less than 90% by weight. The cover 8 in which the content is equal to or greater than 15% by weight can contribute to the resilience performance and the durability of the golf ball 2. In this respect, the content is more preferably equal to or greater than 20% by weight and particularly preferably equal to or greater than 25% by weight. The cover 8 in which the content is equal to or less than 90% by weight can achieve the outer-hard/inner-soft structure. In this respect, the content is more preferably equal to or less than 80% by weight and particularly preferably equal to or less than 70% by weight.

The weight ratio of the polyamide resin (A) with respect to the copolymer (B) in the resin composition of the cover 8 is preferably equal to or greater than 5/95 and equal to or less than 80/20. The resin composition in which the weight ratio is equal to or greater than 5/95 can achieve the outer-hard/inner-soft structure. In this respect, the weight ratio is more preferably equal to or greater than 10/90 and particularly preferably equal to or greater than 20/80. The cover 8 in which the weight ratio is equal to or less than 80/20 can contribute to the resilience performance of the golf ball 2. In this respect, the weight ratio is more preferably equal to or less than 75/25 and particularly preferably equal to or less than 70/30.

The resin (C) having a polar functional group can be obtained by a copolymerization reaction of: a monomer having a polar functional group; and a monomer not having a polar functional group. The polar functional group has excellent affinity with the copolymer (B). On the other hand, the part of the resin (C) other than the polar functional group has excellent affinity with the polyamide resin (A). By the resin composition including the resin (C), the polyamide resin (A) and the copolymer (B) are dispersed with each other. The strength of the cover 8 that includes the resin (C) is high. The resin (C) contributes to the durability of the golf ball 2.

Examples of the polar functional group include an epoxy group, a hydroxyl group, an amino group, a nitro group, a carboxyl group, a formyl group, a nitrile group, and a sulfonic group. Particularly, an epoxy group and a carboxyl group are preferred. Examples of the monomer having a polar functional group include epoxy group-containing monomers such as glycidyl(meth)acrylate, 2-vinyloxirane, and (allyloxy)oxirane; hydroxyl group-containing monomers such as 2-hydroxyethyl(meth)acrylate, 2-hydroxypropyl(meth)acrylate, vinyl alcohol, allyl alcohol, and 2-hydroxyethyl vinyl ether; sulfonic group-containing monomers such as vinyl sulfonic acid; and carboxyl group-containing monomers such as (meth)acrylic acid, itaconic acid, and maleic anhydride. Two or more types of monomers may be used in combination.

Epoxy group-containing monomers are preferred. In the composition that includes the resin (C) formed from the monomer, the epoxy group in the resin (C) reacts with the carboxyl group in the copolymer (B). Glycidyl (meth)acrylate is particularly preferred.

Examples of the monomer not having a polar functional group include olefins such as ethylene, propylene, 1-buten, isobutene, and 1-penten; and alkyl(meth)acrylates such as methyl(meth)acrylate, ethyl(meth)acrylate, propyl(meth) acrylate, n-butyl(meth)acrylate, and isobutyl(meth)acrylate. Two or more types of monomers may be used in combination. Ethylene and methyl(meth)acrylate are preferred.

The content of the monomer component, having a polar functional group, in the resin (C) is preferably equal to or greater than 0.1% by weight. In the resin composition in which the content is equal to or greater than 0.1% by weight, the polyamide resin (A) and the copolymer (B) are sufficiently dispersed with each other. In this respect, the content is more preferably equal to or greater than 0.5% by weight and particularly preferably equal to or greater than 1% by weight. The content is preferably equal to or less than 30% by weight, more preferably equal to or less than 25% by weight, and particularly preferably equal to or less than 20% by weight.

Examples of the resin (C) having a polar functional group include (meth)acrylic acid ester-glycidyl (meth)acrylate copolymers, epoxy group-containing (meth)acrylic polymers, ethylene-glycidyl(meth)acrylate copolymers, ethylene-(meth)acrylic acid copolymers, ethylene-(meth)acrylic acid-(meth)acrylic acid ester copolymers, ethylene-(meth) acrylic acid ester-glycidyl (meth)acrylate copolymers, maleic acid modified styrene-ethylene-butylene-styrene block polymers (SEBS), maleic acid modified styrene-ethylene-butylene-olefin crystal block polymers (SEBC), maleic acid modified polyethylenes (PE), maleic acid modified polypropylenes (PP), maleic acid modified ethylene-vinyl acetate copolymers (EVA), maleic acid modified ethylene-propylene-diene copolymers (EPDM), and epoxy group-containing styrene polymers. Two or more types of resins may be used in combination. An ethylene-glycidyl methacrylate copolymer, an ethylene-acrylic acid-glycidyl methacrylate copolymer, and a methyl methacrylate-glycidyl methacrylate copolymer are particularly preferred.

Specific examples of the resin (C) include trade name "LOTARDER AX8840" available from Arkema Inc.; trade name "ARUFON UG-4030" available from Toagosei Co., Ltd.; trade name "Bond Fast E" available from Sumitomo Chemical Co., Ltd.; trade names "Tuftec M1913" and "Tuftec M1943" available from Asahi Kasei Corporation; trade name "FUSABOND NM052D" available from E.I. du Pont de Nemours and Company; trade name "Dynaron 4630P" available from JSR Corporation; and trade names "NUCREL AN4214C", "NUCREL AN4225C", "NUCREL AN42115C", "NUCREL N0903HC", "NUCREL N0908C", "NUCREL AN42012C", "NUCREL N410", "NUCREL N1035", "NUCREL N1050H", "NUCREL N1108C", "NUCREL N1110H", "NUCREL N1207C", "NUCREL N1214", "NUCREL AN4221C", "NUCREL N1525", "NUCREL N1560", "NUCREL N0200H", "NUCREL AN4228C", "NUCREL N4213C", and "NUCREL N035C", available from Du Pont-MITSUI POLYCHEMICALS Co., Ltd.

The amount of the resin (C) having a polar functional group is equal to or greater than 0.1 part by weight and equal to or less than 20 parts by weight, per total 100 parts by weight of the polyamide resin (A) and the copolymer (B). In the resin composition in which the amount is equal to or greater than 0.1 parts by weight per total 100 parts by weight of the polyamide resin (A) and the copolymer (B), the polyamide resin (A) and the copolymer (B) are dispersed with each other. In this respect, the amount is more preferably equal to or greater than 2 parts by weight per total 100 parts by weight of the polyamide resin (A) and the copolymer (B). The resin composition in which the amount is equal to or less than 20 parts by weight per total 100 parts by weight of the polyamide resin (A) and the copolymer (B), has excellent moldability. In this respect, the amount is more preferably equal to or less than 15 parts by weight and particularly preferably equal to or less than 10 parts by weight, per total 100 parts by weight of the polyamide resin (A) and the copolymer (B).

The resin composition of the cover 8 may include a small amount of a resin that is different from the polyamide resin (A), the copolymer (B), and the resin (C) having a polar functional group. The resin composition may include a coloring agent such as titanium dioxide, a filler such as barium sulfate, a dispersant, an antioxidant, an ultraviolet absorber, a light stabilizer, a fluorescent material, a fluorescent brightener, and the like, in an adequate amount. The resin composition may include powder of a metal with a high specific gravity. Specific examples of metals with a high specific gravity include tungsten and molybdenum.

The resin composition is obtained by blending the polyamide resin (A), the copolymer (B), the resin (C), and additives by using an extruder. The cover 8 is formed from the resin composition by a known method such as injection molding, compression molding, and the like. The resin composition may be obtained by dry blending: pellets that include the copolymer (B) and the additives; and pellets that include the polyamide resin (A) and the resin (C).

The cover 8 has a hardness H6 of preferably 65 or greater and 75 or less. The cover 8 with the hardness H6 of 65 or greater achieves an outer-hard/inner-soft structure. In this respect, the hardness H6 is more preferably equal to or greater than 66 and particularly preferably equal to or greater than 67. The cover 8 with a hardness H6 of 75 or less does not impair the feel at impact and the durability of the golf ball 2. In this respect, the hardness H6 is more preferably equal to or less than 73 and particularly preferably equal to or less than 71.

The hardness H6 is measured according to the standards of "ASTM-D 2240-68" with an automated rubber hardness measurement machine (trade name "P1", available from Kobunshi Keiki Co., Ltd.) to which a Shore D type hardness scale is mounted. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the cover 8 is used for the measurement.

The cover 8 has a flexural modulus of preferably 300 MPa or greater and 1000 MPa or less. The cover 8 with a flexural modulus of 300 MPa or greater achieves the outer-hard/inner-soft structure. In this respect, the flexural modulus is more preferably equal to or greater than 320 MPa and particularly preferably equal to or greater than 350 MPa. The cover 8 with a flexural modulus of 1000 MPa or less has excellent moldability. In addition, the cover 8 with a flexural modulus of 1000 MPa or less does not impair the feel at impact and the durability of the golf ball 2. In this respect, the flexural modulus is more preferably equal to or less than 900 MPa and particularly preferably equal to or less than 800 MPa. The flexural modulus of the cover 8 is measured by the same method as the aforementioned method for measuring the flexural modulus of the polyamide resin (A). For the measurement, a test piece formed from the same resin composition as the resin composition of the cover 8 is used.

The cover 8 has a tensile modulus of preferably 400 MPa or greater and 1500 MPa or less. The cover 8 with a tensile modulus of 400 MPa or greater achieves the outer-hard/inner-soft structure. In this respect, the tensile modulus is more preferably equal to or greater than 410 MPa and particularly preferably equal to or greater than 420 MPa. The cover 8 with a tensile modulus of 1500 MPa or less does not impair the feel at impact and the durability of the golf ball 2. In this respect, the tensile modulus is more preferably equal to or less than 1400 MPa and particularly preferably equal to or less than 1300 MPa.

The tensile modulus is measured according to the standards of ISO178. Prior to the measurement, a sheet is formed by injection molding from the same resin composition as the resin composition of the cover 8. The sheet has a thickness of 2 mm. A dumbbell-shaped test piece is punched out from a sheet maintained at 23° C. for two weeks. The test piece is subjected to the measurement.

The cover 8 has a thickness of preferably 0.3 mm or greater and 3.0 mm or less. The cover 8 with a thickness of 0.3 mm or greater suppresses the spin upon a shot with a driver. In this respect, the thickness is more preferably equal to or greater than 0.5 mm and particularly preferably equal to or greater than 0.7 mm. The cover 8 with a thickness of 3.0 mm or less does not impair the feel at impact. In this respect, the thickness is more preferably equal to or less than 2.0 mm and particularly preferably equal to or less than 1.3 mm.

For forming the cover 8, known methods such as injection molding, compression molding, and the like can be used. When forming the cover 8, the dimples 14 are formed by a large number of pimples formed on the cavity face of a mold.

The Shore D hardness H6 of the cover 8 is greater than the Shore D hardness H5 of the mid layer 6. In the golf ball 2, spin is suppressed due to the outer-hard/inner-soft structure, and excellent feel at impact is obtained due to the mid layer 6. In these respects, the difference (H6−H5) between the hardness H6 and a hardness H5 is preferably equal to or greater than 10, more preferably equal to or greater than 15, and particularly preferably equal to or greater than 20. The difference (H6−H5) is preferably equal to or less than 40.

In light of feel at impact, the golf ball 2 has an amount of compressive deformation D4 of preferably 2.0 mm or greater, more preferably 2.1 mm or greater, and particularly preferably 2.2 mm or greater. In light of resilience performance, the amount of compressive deformation D4 is preferably equal to or less than 3.7 mm, more preferably equal to or less than 3.6 mm, and particularly preferably equal to or less than 3.5 mm.

Figure 2:
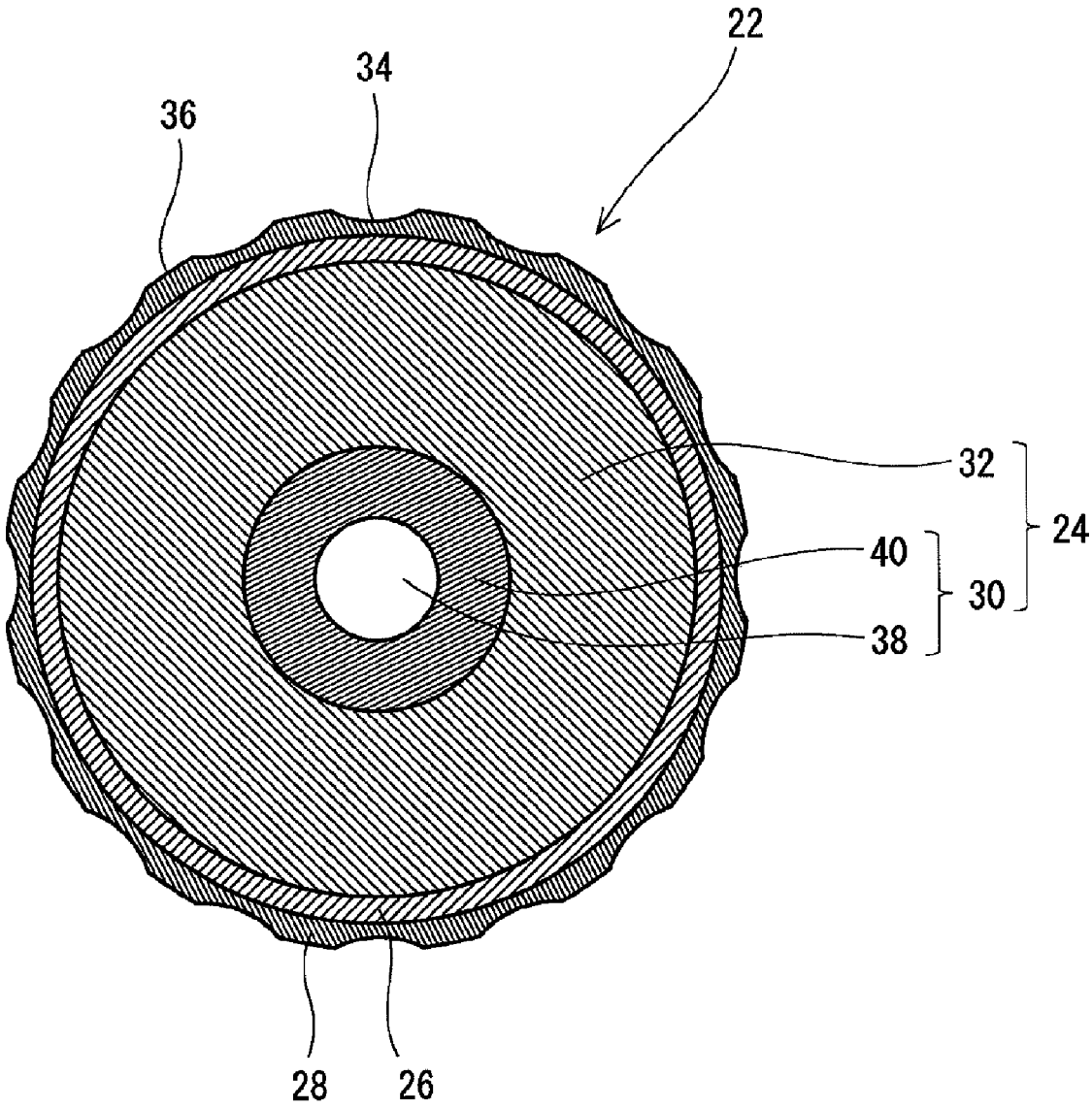
FIG. 2 is a cross-sectional view of a golf ball according to another embodiment of the present invention.

FIG. 2 is a cross-sectional view of a golf ball 22 according to another embodiment of the present invention. The golf ball 22 includes a spherical core 24, a mid layer 26 positioned outside the core 24, and a cover 28. The core 24 includes a spherical center 30 and an envelope layer 32 positioned outside the center 30. The center 30 may have a rib on its surface. On the surface of the cover 28, a large number of dimples 34 are formed. Of the surface of the golf ball 22, a part other than the dimples 34 is a land 36. The golf ball 22 includes a paint layer and a mark layer on the external side of the cover 28 although these layers are not shown in the drawing. The golf ball 22 may not have the mid layer 26. The diameter and the weight of the golf ball 22 are equal to that of the golf ball 2 shown in FIG. 1.

The center 30 has a spherical space 38 and an outer layer 40. In other words, the center 30 is hollow. The hardness at the space 38 is theoretically zero. The center 30 having the space 38 has an ultimate inner-soft structure.

The center 30 is obtained by crosslinking a rubber composition. Examples of preferable base rubbers for use in the rubber composition include natural rubbers, polybutadienes, polyisoprenes, styrene-butadiene copolymers, and ethylene-propylene-diene copolymers. Two or more types of rubbers may be used in combination.

As described later, the outer layer 40 is flexible. In light of achievement of a flexible outer layer 40, a natural rubber is preferably used as the base rubber. When a natural rubber and another rubber are used in combination, the proportion of the natural rubber to the entire base rubber is preferably equal to or greater than 30% by weight and more preferably equal to or greater than 40% by weight.

In light of resilience performance of the golf ball 22, the rubber composition of the center 30 preferably includes a polybutadiene together with a natural rubber. Specifically, the proportion of the polybutadiene to the entire base rubber is preferably equal to or greater than 30% by weight and more preferably equal to or greater than 40% by weight. The proportion of cis-1,4 bonds in the polybutadiene is preferably equal to or greater than 40% and more preferably equal to or greater than 80%.

When a natural rubber and a polybutadiene are used in combination in the rubber composition of the center 30, the weight ratio of them is preferably equal to or greater than 3/7 and equal to or less than 7/3, and is more preferably equal to or greater than 4/6 and equal to or less than 6/4.

The rubber composition of the center 30 includes sulfur. The sulfur crosslinks the rubber molecules. The outer layer 40 obtained by sulfur crosslinking is flexible. The outer layer 40 decreases the step of hardness between the space 38 and the outer layer 40. The flexible outer layer 40 achieves an outer-hard/inner-soft structure with a hardness distribution having excellent continuity, in the center 30. The center 30 suppresses spin. The center 30 also contributes to feel at impact.

In light of resilience performance of the golf ball 22, the amount of the sulfur is preferably equal to or greater than 2.0 parts by weight and particularly preferably equal to or greater than 3.0 parts by weight, per 100 parts by weight of the base rubber. In light of flexibility of the outer layer 40, the amount of the sulfur is preferably equal to or less than 10.0 parts by weight and particularly preferably equal to or less than 6.5 parts by weight, per 100 parts by weight of the base rubber.

Preferably, the rubber composition of the center 30 includes a vulcanization accelerator. The vulcanization accelerator included in the center 10 shown in FIG. 1 can be used for the center 30. The vulcanization accelerator achieves a short time period for crosslinking the center 30. The amount of the vulcanization accelerator is equal to the amount of the vulcanization accelerator in the center 10 shown in FIG. 1.

In a general golf ball, the rubber composition of a center includes an organic peroxide. The organic peroxide contributes to the resilience performance of the golf ball 22. On the other hand, the organic peroxide increases the hardness of the center 30. In the golf ball 22 according to the present invention, the rubber composition of the center 30 does not include an organic peroxide. Due to the rubber composition, a flexible outer layer 40 is obtained.

Preferably, the center 30 includes a reinforcing agent. A preferable reinforcing agent is silica (white carbon). The silica can achieve a proper rigidity of the center 30. Dry-process silica and wet-process silica can be used. In light of rigidity of the center 30, the amount of the silica is preferably equal to or greater than 3 parts by weight and particularly preferably equal to or greater than 5 parts by weight, per 100 parts by weight of the base rubber. In light of flexibility of the center 30, the amount of the silica is preferably equal to or less than 20 parts by weight and particularly preferably equal to or less than 10 parts by weight, per 100 parts by weight of the base rubber. A silane coupling agent may be included together with silica.

For the purpose of adjusting specific gravity and the like, a filler may be included in the rubber composition of the center 30. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the outer layer 40 is accomplished. A particularly preferable filler is zinc oxide. Zinc oxide serves not only as a specific gravity adjuster but also as a crosslinking activator.

As a filler, a clay may be used. A hard clay and a soft clay can be used. The clay enhances the air impermeability of the outer layer 40. Due to the clay, leak of the gas in the space 38 can be prevented. A kaolin clay is particularly preferred.

According to need, various additives such as an anti-aging agent, a coloring agent, a plasticizer, a dispersant, a co-crosslinking agent, an organic sulfur compound, and the like are included in the center 30 in an adequate amount. Crosslinked rubber powder or synthetic resin powder may be also included in the center 30.

In light of continuity of the hardness distribution, the center 30 has a hardness H1, at its innermost portion, of preferably 35 or less, more preferably 33 or less, and particularly preferably 32 or less. In light of resilience performance and durability, the hardness H1 is preferably equal to or greater than 17, more preferably equal to or greater than 22, and particularly preferably equal to or greater than 27. The hardness H1 is measured for a cut plane of the center 30 that has been cut into two halves. The hardness H1 is measured by pressing a JIS-C type hardness scale against the cut plane. The hardness scale is pressed against a region surrounded by: a first circle that is the boundary between the space 38 and the outer layer 40; and a second circle that is concentric with the first circle and has a radius larger than the radius of the first circle by 1 mm. For the measurement, an automated rubber hardness measurement machine (trade name "P1", available from Kobunshi Keiki Co., Ltd.), to which this hardness scale is mounted, is used.

The hardness of the center 30 gradually increases from its innermost portion toward its surface. The center 30 has a surface hardness H2 greater than the innermost portion hardness H1. The great surface hardness H2 can achieve continuity of hardness between the center 30 and the envelope layer 32. In this respect, the surface hardness H2 of the center 30 is preferably equal to or greater than 25 and particularly preferably equal to or greater than 30. In light of continuity of the hardness distribution, the surface hardness H2 is preferably equal to or less than 55, more preferably equal to or less than 45, and particularly preferably equal to or less than 37. The surface hardness H2 is measured by pressing a JIS-C type hardness scale against the surface of the center 30. For the measurement, an automated rubber hardness measurement machine (trade name "P1", available from Kobunshi Keiki Co., Ltd.), to which this hardness scale is mounted, is used.

In light of feel at impact, the difference (H2−H1) between the surface hardness H2 and the innermost portion hardness H1 is preferably equal to or greater than 1, more preferably equal to or greater than 2, and particularly preferably equal to or greater than 3. In light of resilience performance, the difference (H2−H1) is preferably equal to or less than 15, more preferably equal to or less than 10, and particularly preferably equal to or less than 5.

In light of feel at impact, the center 30 has an amount of compressive deformation D1 of preferably 1.0 mm or greater, more preferably 1.5 mm or greater, and particularly preferably 1.7 mm or greater. In light of resilience performance, the amount of compressive deformation D1 is preferably equal to or less than 3.0 mm, more preferably equal to or less than 2.6 mm, and particularly preferably equal to or less than 2.4 mm.

Upon measurement of the amount of compressive deformation, first, a sphere is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load is applied to the sphere up to the state in which a final load is applied thereto, is the amount of compressive deformation. In measuring the amount of compressive deformation D1 of the center 30, the initial load is 0.3 N and the final load is 29.4 N. In measuring the amount of compressive deformation D2 of the core 24, the amount of compressive deformation D3 of a sphere consisting of the core 24 and the mid layer 26, and the amount of compressive deformation D4 of the golf ball 22, the initial load is 98 N and the final load is 1274 N.

In light of continuity of the hardness distribution of the center 30, the center 30 has an inner diameter (outer diameter of the space 38) of preferably 2 mm or greater and 13 mm or less. The inner diameter is more preferably equal to or greater than 3 mm. The inner diameter is more preferably equal to or less than 10 mm and particularly preferably equal to or less than 8 mm.

The center 30 has an outer diameter smaller than that of the center of a general golf ball. Due to the small center 30, the envelope layer 32 can be formed with a sufficient thickness. The envelope layer 32 can achieve an outer-hard/inner-soft structure with a hardness distribution having excellent continuity. The small center 30 suppresses spin. Even if being flexible, the small center 30 does not impair the resilience performance of the golf ball 22. In light of continuity of the hardness distribution and resilience performance, the outer diameter of the center 30 is preferably equal to or less than 15 mm, more preferably equal to or less than 14 mm, and particularly preferably equal to or less than 10 mm. From the standpoint that the center 30 can contribute to suppression of spin, the outer diameter is preferably equal to or greater than 5 mm. The center 30 may have a rib on its surface.

The space 38 has no weight. The weight of the golf ball 22 is biased so as to be greater on the outer side than on the inner side. Due to this weight distribution, a great moment of inertia is obtained. The great moment of inertia suppresses initial spin.

Figure 3:
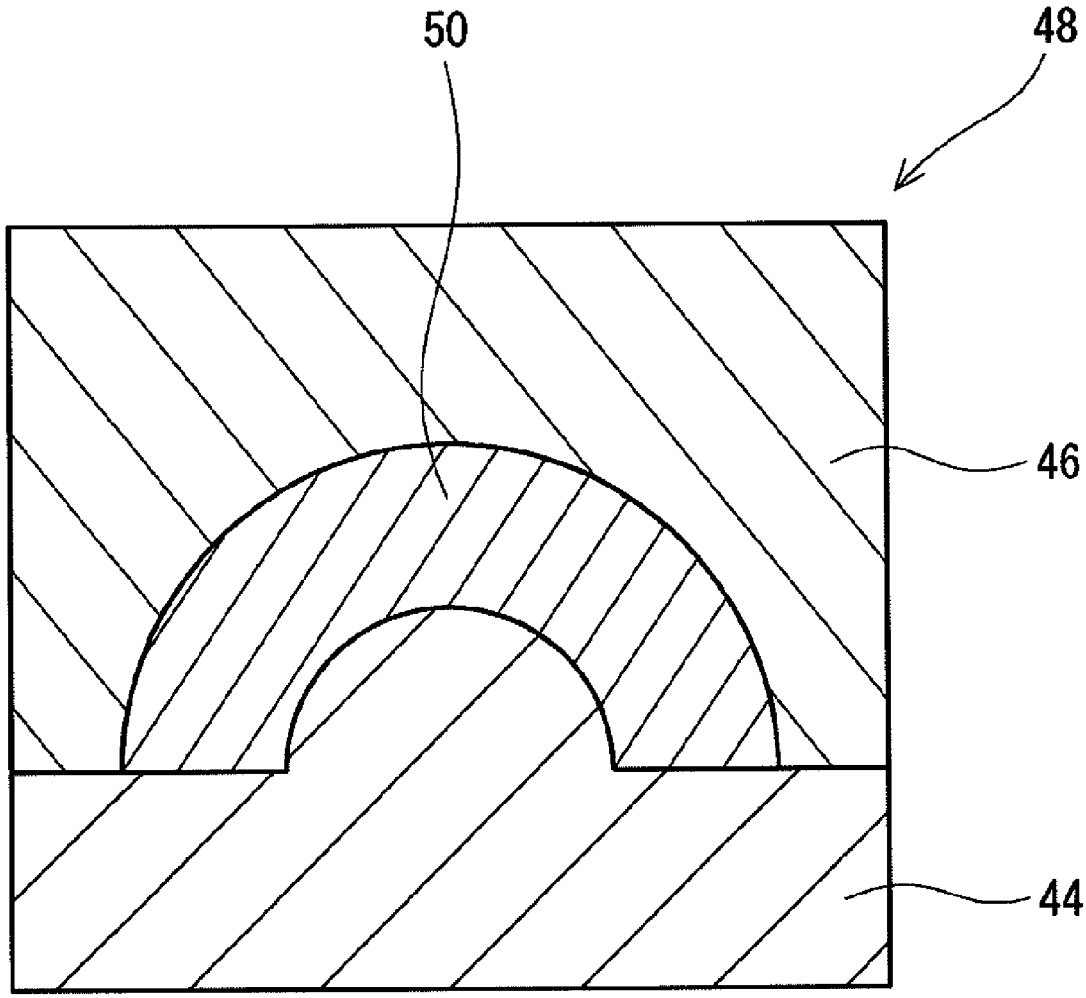
FIG. 3 is a cross-sectional view showing a mold used for producing a center of the golf ball in FIG. 2, together with a half shell.

In order to obtain the center 30, the rubber composition is injected into the cavity of a mold 48 that includes a male mold part 44 and a female mold part 46 as shown in FIG. 3. The rubber composition is compressed and heated in the cavity, and flows. Due to this flow, a half shell 50 is obtained. The mold 48 is opened, and the half shell 50 is taken out. The half shell 50 is in an uncrosslinked state or in a semi-crosslinked state. Two half shells 50 are fitted together, and placed into a mold having a spherical cavity. The half shells 50 are compressed and heated in the mold. By this heating, a crosslinking reaction of rubber takes place to join the half shells 50. By this joining, a hollow center 30 is obtained. Prior to fitting of the half shells, a rubber cement is preferably applied to the joining surfaces of the half shells. Preferably, a rubber cement in which a rubber composition that includes the same ingredients as that of the rubber composition of the center 30 is dissolved in a solvent, is used. Prior to fitting of the half shells, a compound for applying internal pressure is preferably put into the half shells. Typical compounds are ammonium chloride and sodium nitrite. Preferably, tablets of ammonium chloride, tablets of sodium nitrite, and water are put into the half shells. Due to a chemical reaction of ammonium chloride and sodium nitrite, nitrogen gas is produced. The nitrogen gas increases the internal pressure of the center 30.

The envelope layer 32 is obtained by crosslinking a rubber composition. The materials of the envelope layer 32 are the same as the materials of the envelope layer 12 shown in FIG. 1. The hardness of the envelope layer 32 gradually increases from its innermost portion toward its surface (the surface of the core 24). The envelope layer 32 has a low hardness H3 at its innermost portion, and a great hardness H4 at its surface. The low hardness H3 can achieve the continuity of hardness between the center 30 and the envelope layer 32. The great hardness H4 achieves the outer-hard/inner-soft structure of the core 24. The envelope layer 32 sufficiently suppresses spin.

In light of resilience performance, the innermost portion hardness H3 is preferably equal to or greater than 45, more preferably equal to or greater than 55, and particularly preferably equal to or greater than 63. In light of continuity of the hardness distribution, the innermost portion hardness H3 is preferably equal to or less than 75, more preferably equal to or less than 70, and particularly preferably equal to or less than 67. The hardness H3 is measured for a hemisphere obtained by cutting the core 24. The hardness H3 is measured by pressing a JIS-C type hardness scale against the cut plane of the hemisphere. The hardness scale is pressed against a region surrounded by: a first circle that is the boundary between the center 30 and the envelope layer 32; and a second circle that is concentric with the first circle and has a radius larger than the radius of the first circle by 1 mm. For the measurement, an automated rubber hardness measurement machine (trade name "P1", available from Kobunshi Keiki Co., Ltd.), to which this hardness scale is mounted, is used.

In light of achievement of the outer-hard/inner-soft structure, the surface hardness H4 of the core 24 is preferably equal to or greater than 65, more preferably equal to or greater than 75, and particularly preferably equal to or greater than 79. In light of feel at impact, the hardness H4 is preferably equal to or less than 90 and more preferably equal to or less than 85. The hardness H4 is measured by pressing a JIS-C type hardness scale against the surface of the core 24 (i.e., the surface of the envelope layer 32). For the measurement, an automated rubber hardness measurement machine (trade name "P1", available from Kobunshi Keiki Co., Ltd.), to which this hardness scale is mounted, is used.

In light of suppression of spin, the difference (H4−H3) between the surface hardness H4 of the core 24 and the innermost portion hardness H3 of the envelope layer 32 is preferably equal to or greater than 10, more preferably equal to or greater than 13, and particularly preferably equal to or greater than 14. In light of ease of production, the difference (H4−H3) is preferably equal to or less than 25, more preferably equal to or less than 20, and particularly preferably equal to or less than 18.

In light of achievement of a great difference (H4−H3), the envelope layer 32 has a thickness of preferably 10 mm or greater, more preferably 11 mm or greater, and particularly preferably 12 mm or greater. The thickness is preferably equal to or less than 20 mm.

The temperature for crosslinking the envelope layer 32 is generally equal to or higher than 140° C. and equal to or lower than 180° C. The time period for crosslinking the envelope layer 32 is generally equal to or longer than 10 minutes and equal to or shorter than 60 minutes. The envelope layer 32 may have a rib on its surface.

In light of continuity of the hardness distribution, the difference (H3−H2) between the innermost portion hardness H3 of the envelope layer 32 and the surface hardness H2 of the center 30 is preferably equal to or less than 35 and more preferably equal to or less than 33. The difference (H3−H2) may be zero.

In light of suppression of spin, a difference (H4−H2) between the surface hardness H4 of the core 24 and the surface hardness H2 of the center 30 is preferably equal to or greater than 40 and particularly preferably equal to or greater than 43. In light of ease of production, the difference (H4−H2) is preferably equal to or less than 55 and particularly preferably equal to or less than 50.

In light of suppression of spin, a difference (H4−H1) between the surface hardness H4 of the core 24 and the innermost portion hardness H1 of the center 30 is preferably equal to or greater than 40, more preferably equal to or greater than 43, and particularly preferably equal to or greater than 46. In light of ease of production, the difference (H4−H1) is preferably equal to or less than 65, more preferably equal to or less than 60, and particularly preferably equal to or less than 55.

In light of feel at impact, the core 24 has an amount of compressive deformation D2 of preferably 2.5 mm or greater, more preferably 3.0 mm or greater, and particularly preferably 3.3 mm or greater. In light of resilience performance, the amount of compressive deformation D2 is preferably equal to or less than 4.5 mm, more preferably equal to or less than 4.0 mm, and particularly preferably equal to or less than 3.8 mm.

In light of resilience performance, the core 24 has a diameter of preferably 30.0 mm or greater, more preferably 35.0 mm or greater, and particularly preferably 38.0 mm or greater. In light of durability of the golf ball 22, the diameter of the core 24 is preferably equal to or less than 40.2 mm, more preferably equal to or less than 39.9 mm, and particularly preferably equal to or less than 39.6 mm.

As described above, the golf ball 22 includes the mid layer 26 and the cover 28. The mid layer 26 is flexible, and the cover 28 is hard. The cover 28 achieves an outer-hard/inner-soft structure of the golf ball 22. In the golf ball 22, spin is suppressed. Further the cover 28 achieves excellent resilience performance of the golf ball 22. Because the mid layer 26 is flexible, the shock at impact can be absorbed. Even though the cover 28 is hard, the mid layer 26 achieves soft feel at impact of the golf ball 22.

A resin composition is suitably used for the mid layer 26. The materials of the mid layer 26 are the same as the materials of the mid layer 6 shown in FIG. 1.

In light of resilience performance, the mid layer 26 has a hardness H5 of preferably 20 or greater, more preferably 30 or greater, and particularly preferably 35 or greater. In light of feel at impact, the hardness H5 is preferably equal to or less than 60, more preferably equal to or less than 55, and particularly preferably equal to or less than 50.

The hardness H5 is measured according to the standards of "ASTM-D 2240-68" with an automated rubber hardness measurement machine (trade name "P1", available from Kobunshi Keiki Co., Ltd.) to which a Shore D type spring hardness scale is mounted. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the mid layer 26 is used for the measurement.

In light of feel at impact, the mid layer 26 has a thickness of preferably 0.3 mm or greater, more preferably 0.5 mm or greater, and particularly preferably 0.7 mm or greater. In light of resilience performance, the thickness is preferably equal to or less than 2.5 mm, more preferably equal to or less than 2.0 mm, and particularly preferably equal to or less than 1.5 mm.

In light of feel at impact, the sphere consisting of the core 24 and the mid layer 26 has an amount of compressive deformation D3 of preferably 2.5 mm or greater, more preferably 3.0 mm or greater, and particularly preferably 3.3 mm or greater. In light of resilience performance, the amount of compressive deformation D3 is preferably equal to or less than 4.5 mm, more preferably equal to or less than 4.0 mm, and particularly preferably equal to or less than 3.7 mm.

The materials of the cover 28 are the same as the materials of the cover 8 shown in FIG. 1. The resin composition of the cover 28 includes:

(A) a highly elastic polyamide resin with a flexural modulus of 700 MPa or greater and 5000 MPa or less.

The cover 28 that includes the polyamide resin (A) has a high rigidity. The cover 28 achieves the outer-hard/inner-soft structure of the golf ball 22. When the golf ball 22 having the outer-hard/inner-soft structure is hit with a driver, a high launch angle is obtained. When the golf ball 22 is hit with a driver, the golf ball 22 flies at a low spin rate. Due to the high launch angle and the low spin rate, a long flight distance is obtained. The polyamide resin (A) also contributes to the low-temperature durability of the golf ball 22.

The cover 28 has a hardness H6 of preferably 65 or greater and 75 or less. The cover 28 with the hardness H6 of 65 or greater achieves the outer-hard/inner-soft structure. In this respect, the hardness H6 is more preferably equal to or greater than 66 and particularly preferably equal to or greater than 67. The cover 28 with the hardness H6 of 75 or less does not impair the feel at impact and the durability of the golf ball 22. In this respect, the hardness H6 is more preferably equal to or less than 74 and particularly preferably equal to or less than 73.

The hardness H6 is measured according to the standards of "ASTM-D 2240-68" with an automated rubber hardness measurement machine (trade name "P1", available from Kobunshi Keiki Co., Ltd.) to which a Shore D type hardness scale is mounted. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the cover 28 is used for the measurement.

The cover 28 has a flexural modulus of preferably 300 MPa or greater and 1000 MPa or less. The cover 28 with a flexural modulus of 300 MPa or greater achieves the outer-hard/inner-soft structure. In this respect, the flexural modulus is more preferably equal to or greater than 320 MPa and particularly preferably equal to or greater than 350 MPa. The cover 28 with a flexural modulus of 1000 MPa or less has excellent moldability. In addition, the cover 28 with a flexural modulus of 1000 MPa or less does not impair the feel at impact and the durability of the golf ball 22. In this respect, the flexural modulus is more preferably equal to or less than 900 MPa and particularly preferably equal to or less than 800 MPa. The flexural modulus of the cover 28 is measured by the same method as the aforementioned for measuring the flexural modulus of the polyamide resin (A). For the measurement, a test piece formed from the same resin composition as the resin composition of the cover 28 is used.

The cover 28 has a tensile modulus of preferably 400 MPa or greater and 1500 MPa or less. The cover 28 with a tensile modulus of 400 MPa or greater achieves the outer-hard/inner-soft structure. In this respect, the tensile modulus is more preferably equal to or greater than 410 MPa and particularly preferably equal to or greater than 420 MPa. The cover 28 with a tensile modulus of 1500 MPa or less does not impair the feel at impact and the durability of the golf ball 22. In this respect, the tensile modulus is more preferably equal to or less than 1400 MPa and particularly preferably equal to or less than 1300 MPa.

The tensile modulus is measured according to the standards of ISO178. Prior to the measurement, a sheet is formed by injection molding from the same resin composition as the resin composition of the cover 28. The sheet has a thickness of 2 mm. A dumbbell-shaped test piece is punched out from a sheet maintained at 23° C. for two weeks. The test piece is subjected to the measurement.

The cover 28 has a thickness of preferably 0.3 mm or greater and 3.0 mm or less. The cover 28 with a thickness of 0.3 mm or greater suppresses the spin upon a shot with a driver. In this respect, the thickness is more preferably equal to or greater than 0.5 mm and particularly preferably equal to or greater than 0.7 mm. The cover 28 with a thickness of 3.0 mm or less does not impair the feel at impact. In this respect, the thickness is more preferably equal to or less than 2.0 mm and particularly preferably equal to or less than 1.3 mm.

For forming the cover 28, known methods such as injection molding, compression molding, and the like can be used. When forming the cover 28, the dimples 34 are formed by a large number of pimples formed on the cavity face of a mold.

The Shore D hardness H6 of the cover 28 is greater than the Shore D hardness H5 of the mid layer 26. In the golf ball 22, spin is suppressed due to the outer-hard/inner-soft structure, and excellent feel at impact is obtained due to the mid layer 26. In these respects, the difference (H6−H5) between the hardness H6 and the hardness H5 is preferably equal to or greater than 10, more preferably equal to or greater than 15, and particularly preferably equal to or greater than 20. The difference (H6−H5) is preferably equal to or less than 40.

In light of feel at impact, the golf ball 22 has an amount of compressive deformation D4 of preferably 2.0 mm or greater, more preferably 2.5 mm or greater, and particularly preferably 2.7 mm or greater. In light of resilience performance, the amount of compressive deformation D4 is preferably equal to or less than 4.3 mm, more preferably equal to or less than 3.8 mm, and particularly preferably equal to or less than 3.5 mm.

EXAMPLES

[Experiment 1]

[Example 1]

A rubber composition (a) was obtained by kneading 100 parts by weight of a high-cis polybutadiene (trade name "BR-730", available from JSR Corporation), 5 parts by weight of zinc oxide, an appropriate amount of barium sulfate, 10 parts by weight of silica (trade name "Nipsil AQ", available from Tosoh Silica Corporation), 2.20 parts by weight of a sulfenamide type vulcanization accelerator (the aforementioned "Nocceler CZ"), 2.26 parts by weight of a guanidine type vulcanization accelerator (the aforementioned "Soxinol DG"), and 3.4 parts by weight of sulfur. The rubber composition (a) was placed into a mold that included upper and lower mold halves each having a hemispherical cavity, and heated at 150° C. for 5 minutes to obtain a center with a diameter of 10 mm.

A rubber composition (f) was obtained by kneading 100 parts by weight of a high-cis polybutadiene (the aforementioned "BR-730"), 29 parts by weight of zinc diacrylate, 5 parts by weight of zinc oxide, an appropriate amount of barium sulfate, 0.5 part by weight of bis(pentabromophenyl) disulfide, and 0.7 part by weight of dicumyl peroxide (available from NOF Corporation). Two half shells were formed from the rubber composition (f). The center was covered with the two half shells. The center and the half shells were placed into a mold that included upper and lower mold halves each having a hemispherical cavity, and heated at 170° C. for 20 minutes to obtain an envelope layer with a thickness of 14.4 mm. The amount of barium sulfate was adjusted such that the specific gravity of the envelope layer agreed with the specific gravity of the center and the weight of a golf ball was 45.6 g.

A resin composition (B) was obtained by kneading 35 parts by weight of a sodium-neutralized ionomer resin (the aforementioned "Surlyn 8945"), 34 parts by weight of a zinc-neutralized ionomer resin (the aforementioned "Himilan AM7329"), 31 parts by weight of a styrene block-containing thermoplastic elastomer (the aforementioned "Rabalon T3221C"), and 3 parts by weight of titanium dioxide with a twin-screw kneading extruder. The core was placed into a mold that included upper and lower mold halves each having a hemispherical cavity. The core was covered with the resin composition (B) by injection molding to form a mid layer with a thickness of 1.0 mm.

A resin composition (1) was obtained by kneading 30 parts by weight of a highly elastic polyamide (the aforementioned "Novamid ST220"), 30 parts by weight of a sodium-neutralized ionomer resin (an ethylene-(meth)acrylic acid copolymer, the aforementioned "Surlyn 8945"), 40 parts by weight of a zinc-neutralized ionomer resin (an ethylene-(meth) acrylic acid copolymer, the aforementioned "Himilan AM7329"), 5 parts by weight of a resin having a polar functional group (the aforementioned "LOTARDER AX8840"), and 3 parts by weight of titanium dioxide with a twin-screw kneading extruder. The sphere that included the mid layer was placed into a final mold that included upper and lower mold halves each having a hemispherical cavity and that had a large number of pimples on its cavity face. The sphere was covered with the resin composition (1) by injection molding to form a cover with a thickness of 1.0 mm. A large number of dimples having a shape that was the inverted shape of the pimples were formed on the cover. A clear paint that included a two-component curing type polyurethane as a base material was applied to the cover to obtain a golf ball of Example 1 with a diameter of 42.8 mm and a weight of 45.6 g.

[Examples 2 to 11 and Comparative Examples 1 to 10]

Golf balls of Examples 2 to 11 and Comparative Examples 1 to 10 were obtained in a similar manner as Example 1, except the specifications of the center, the envelope layer, the mid layer, and the cover were as shown in the following Tables 4 to 8. The rubber compositions of the center and the envelope layer are shown in detail in the following Table 1. The resin composition of the mid layer is shown in detail in the following Table 2. The resin composition of the cover is shown in detail in the following Table 3. The golf ball of Comparative Example 1 does not have an envelope layer.

[Shot with Driver (W#1)]

A driver with a titanium head (trade name "XXIO", available from SRI Sports Limited, shaft hardness: R, loft angle: 11.0°) was attached to a swing machine available from Golf Laboratories, Inc. A golf ball was hit under the condition of a head speed of 40 m/sec, and the distance from the launch point to the stop point was measured. In addition, the ball speed and the backspin rate were measured immediately after the hit. The average value of data obtained by 12 measurements is shown in the following Tables 4 to 8.

[Durability]

A driver with a titanium head was attached to a swing machine available from Golf Laboratories, Inc. A golf ball was hit under the condition of a head speed of 45 m/sec. This hitting was repeated, and the number of hits required to break the golf ball was counted. The average value of data obtained by 6 measurements is shown as an index in the following Tables 4 to 8. It is noted that when the cover was not broken and the core or the mid layer was broken, the breakage was recognized by the hitting sound or the shape of the golf ball.

TABLE 1

Compositions of Center and Envelope Layer (parts by weight)

| | a | b | c | d | e | f | g | h |
|---|---|---|---|---|---|---|---|---|
| Polybutadiene | 100 | 100 | 100 | 100 | 100 | 100 | 100 | 100 |
| Zinc diacrylate | — | 2 | 10 | 15 | 28 | 29 | 33 | 40 |
| Zinc oxide | 5 | 5 | 5 | 5 | 5 | 5 | 5 | 5 |
| Barium sulfate | *1 | *1 | *1 | *1 | *1 | *1 | *1 | *1 |
| Silica | 10 | — | — | — | — | — | — | — |
| Diphenyl disulfide | — | 0.5 | 0.5 | 0.5 | — | — | — | — |
| Bis(pentabromophenyl)disulfide | — | — | — | — | 0.5 | 0.5 | 0.5 | 0.5 |
| Dicumyl peroxide | — | 0.7 | 0.7 | 0.7 | 0.7 | 0.7 | 0.7 | 0.7 |
| Vulcanization accelerator CZ | 2.20 | — | — | — | — | — | — | — |
| Vulcanization accelerator DG | 2.26 | — | — | — | — | — | — | — |
| Sulfur | 3.4 | — | — | — | — | — | — | — |
| Crosslinking temperature (° C.) | 150 | 170 | 170 | 170 | 170 | 170 | 170 | 170 |
| Crosslinking time (min) | 5 | 10 | 10 | 10 | 20 | 20 | 20 | 20 |

*1 Appropriate amount

TABLE 2

Composition of Mid Layer (parts by weight)

| | A | B | C |
|---|---|---|---|
| Surlyn 8945 | 26 | 35 | 39 |
| Himilan AM7329 | 26 | 34 | 38 |
| Rabalon T3221C | 48 | 31 | 23 |
| Titanium dioxide | 3 | 3 | 3 |
| Hardness H5 (Shore D) | 35 | 45 | 50 |

TABLE 3

Composition of Cover (parts by weight)

| | (1) | (2) | (3) | (4) | (5) | (6) | (7) | (8) | (9) | (10) | (11) | (12) | (13) | (14) |
|---|---|---|---|---|---|---|---|---|---|---|---|---|---|---|
| (A) Novamid ST220 *2 | 30 | 10 | 70 | 30 | 30 | 30 | — | — | 3 | 85 | 30 | 30 | 30 | — |
| (A) Amilan U141 *3 | — | — | — | — | — | — | 60 | — | — | — | — | — | — | — |
| (B) Surlyn 8945 | 30 | 40 | 15 | 30 | 30 | 30 | 20 | 40 | 40 | 5 | 30 | 30 | 30 | 45 |
| (B) Himilan AM7329 | 40 | 50 | 15 | 40 | 40 | 40 | 20 | 60 | 57 | 10 | 40 | 40 | 40 | 45 |
| (C) LOTARDER AX8840 | 5 | 5 | 5 | 3 | 1 | 15 | 5 | — | 5 | 5 | — | 0.05 | 25 | 5 |
| (C) ARUFON UG-4030 | — | — | — | 2 | — | — | — | — | — | — | — | — | — | — |
| Pebax 4033SA *4 | — | — | — | — | — | — | — | — | — | — | — | — | — | 10 |
| Titanium dioxide | 3 | 3 | 3 | 3 | 3 | 3 | 3 | 3 | 3 | 3 | 3 | 3 | 3 | 3 |
| Hardness H6 (Shore D) | 67 | 66 | 73 | 68 | 68 | 65 | 70 | 64 | 64 | 76 | 68 | 68 | 63 | 63 |
| Flexural modulus (MPa) | 460 | 365 | 530 | 480 | 450 | 360 | 495 | 350 | 360 | 700 | 485 | 445 | 285 | 260 |
| Tensile modulus (MPa) | 570 | 420 | 875 | 590 | 545 | 430 | 620 | 345 | 380 | 890 | 600 | 530 | 340 | 280 |

*2 Flexural modulus: 2000 MPa

*3 Flexural modulus: 1500 MPa

*4 Thermoplastic polyamide elastomer available from Arkema Inc., flexural modulus: 84 MPa

TABLE 4

| Results of Evaluation | | | | | |
|---|---|---|---|---|---|
| | | Example 1 | Example 2 | Example 3 | Example 4 |
| Center | Composition | a | a | a | b |
| | Diameter (mm) | 10 | 5 | 15 | 10 |
| | Hardness H1 (JIS-C) | 30 | 30 | 30 | 25 |
| | Hardness H2 (JIS-C) | 32 | 32 | 33 | 30 |
| Envelope layer | Composition | f | e | g | f |
| | Thickness (mm) | 14.4 | 16.6 | 12.2 | 14.4 |
| | Hardness H3 (JIS-C) | 65 | 63 | 67 | 65 |
| Core | Diameter (mm) | 38.8 | 38.2 | 39.4 | 38.8 |
| | Hardness H4 (JIS-C) | 80 | 79 | 81 | 80 |
| | Difference H4 − H3 | 15 | 16 | 14 | 15 |
| | Difference H3 − H2 | 33 | 31 | 34 | 35 |
| | Difference H4 − H1 | 50 | 49 | 51 | 55 |
| | Deformation D2 | 3.55 | 3.60 | 3.48 | 3.56 |
| Mid layer | Composition | B | A | C | B |
| | Thickness (mm) | 1.0 | 1.0 | 1.0 | 1.0 |
| | Hardness H5 (Shore D) | 45 | 35 | 50 | 45 |
| Sphere *5 | Diameter (mm) | 40.8 | 40.2 | 41.4 | 40.8 |
| | Deformation D3 | 3.3 | 3.4 | 3.2 | 3.3 |
| Cover | Composition | (1) | (1) | (1) | (1) |
| | Flexural modulus (MPa) | 460 | 460 | 460 | 460 |
| | Tensile modulus (MPa) | 570 | 570 | 570 | 570 |
| | Thickness (mm) | 1.0 | 1.3 | 0.7 | 1.0 |
| | Hardness H6 (Shore D) | 67 | 67 | 67 | 67 |
| Ball | Deformation D4 (mm) | 3.00 | 3.00 | 3.00 | 3.00 |
| Initial speed (m/s) | | 58.4 | 58.4 | 58.4 | 58.4 |
| Spin rate (rpm) | | 2250 | 2300 | 2200 | 2240 |
| Flight distance (m) | | 207.0 | 206.0 | 207.5 | 207.0 |
| Durability | | 115 | 120 | 105 | 115 |

*5 Sphere consisting of a core and a mid layer

TABLE 5

| Results of Evaluation | | | | | |
|---|---|---|---|---|---|
| | | Example 5 | Example 6 | Example 7 | Example 8 |
| Center | Composition | c | a | a | a |
| | Diameter (mm) | 10 | 10 | 10 | 10 |
| | Hardness H1 (JIS-C) | 40 | 30 | 30 | 30 |
| | Hardness H2 (JIS-C) | 45 | 32 | 32 | 32 |
| Envelope layer | Composition | f | f | e | f |
| | Thickness (mm) | 14.4 | 14.4 | 14.4 | 14.4 |
| | Hardness H3 (JIS-C) | 65 | 65 | 65 | 65 |
| Core | Diameter (mm) | 38.8 | 38.8 | 38.8 | 38.8 |
| | Hardness H4 (JIS-C) | 80 | 80 | 79 | 80 |
| | Difference H4 − H3 | 15 | 15 | 14 | 15 |
| | Difference H3 − H2 | 20 | 33 | 33 | 33 |
| | Difference H4 − H1 | 40 | 50 | 49 | 50 |
| | Deformation D2 | 3.53 | 3.55 | 3.65 | 3.55 |
| Mid layer | Composition | B | B | B | B |
| | Thickness (mm) | 1.0 | 1.0 | 1.0 | 1.0 |
| | Hardness H5 (Shore D) | 45 | 45 | 45 | 45 |
| Sphere *5 | Diameter (mm) | 40.8 | 40.8 | 40.8 | 40.8 |
| | Deformation D3 | 3.3 | 3.3 | 3.4 | 3.3 |
| Cover | Composition | (1) | (2) | (3) | (4) |
| | Flexural modulus (MPa) | 460 | 365 | 530 | 480 |
| | Tensile modulus (MPa) | 570 | 420 | 875 | 590 |
| | Thickness (mm) | 1.0 | 1.0 | 1.0 | 1.0 |
| | Hardness H6 (Shore D) | 67 | 66 | 73 | 68 |
| Ball | Deformation D4 (mm) | 3.00 | 3.00 | 3.00 | 3.00 |
| Initial speed (m/s) | | 58.4 | 58.4 | 58.3 | 58.4 |
| Spin rate (rpm) | | 2270 | 2270 | 2210 | 2240 |
| Flight distance (m) | | 206.5 | 206.5 | 206.5 | 207.0 |
| Durability | | 115 | 125 | 110 | 120 |

TABLE 6

| Results of Evaluation | | | | | |
|---|---|---|---|---|---|
| | | Example 9 | Example 10 | Example 11 | Compara. Example 1 |
| Center | Composition | a | a | a | e |
| | Diameter (mm) | 10 | 10 | 10 | 38.2 |
| | Hardness H1 (JIS-C) | 30 | 30 | 30 | 62 |
| | Hardness H2 (JIS-C) | 32 | 32 | 32 | 79 |
| Envelope layer | Composition | f | f | f | — |
| | Thickness (mm) | 14.4 | 14.4 | 14.4 | — |
| | Hardness H3 (JIS-C) | 65 | 65 | 65 | — |
| Core | Diameter (mm) | 38.8 | 38.8 | 38.8 | 38.2 |
| | Hardness H4 (JIS-C) | 80 | 80 | 80 | 79 (H2) |
| | Difference H4 − H3 | 15 | 15 | 15 | — |
| | Difference H3 − H2 | 33 | 33 | 33 | — |
| | Difference H4 − H1 | 50 | 50 | 50 | 17 |
| | Deformation D2 | 3.55 | 3.55 | 3.55 | 3.60 |
| Mid layer | Composition | B | B | B | A |
| | Thickness (mm) | 1.0 | 1.0 | 1.0 | 1.0 |
| | Hardness H5 (Shore D) | 45 | 45 | 45 | 35 |
| Sphere *5 | Diameter (mm) | 40.8 | 40.8 | 40.8 | 40.2 |
| | Deformation D3 | 3.3 | 3.3 | 3.3 | 3.4 |
| Cover | Composition | (5) | (6) | (7) | (1) |
| | Flexural modulus (MPa) | 450 | 360 | 495 | 460 |
| | Tensile modulus (MPa) | 545 | 430 | 620 | 570 |
| | Thickness (mm) | 1.0 | 1.0 | 1.0 | 1.3 |
| | Hardness H6 (Shore D) | 68 | 65 | 70 | 67 |
| Ball | Deformation D4 (mm) | 3.00 | 3.00 | 3.00 | 3.00 |
| Initial speed (m/s) | | 58.4 | 58.4 | 58.4 | 58.4 |
| Spin rate (rpm) | | 2250 | 2300 | 2200 | 2350 |
| Flight distance (m) | | 207.0 | 206.0 | 207.5 | 205.0 |
| Durability | | 105 | 115 | 130 | 125 |

TABLE 7

| Results of Evaluation | | | | | |
|---|---|---|---|---|---|
| | | Compara. Example 2 | Compara. Example 3 | Compara. Example 4 | Compara. Example 5 |
| Center | Composition | a | d | a | a |
| | Diameter (mm) | 20 | 10 | 10 | 10 |
| | Hardness H1 (JIS-C) | 30 | 55 | 30 | 30 |
| | Hardness H2 (JIS-C) | 34 | 59 | 32 | 32 |
| Envelope layer | Composition | h | e | f | f |
| | Thickness (mm) | 9.4 | 14.4 | 14.4 | 14.4 |
| | Hardness H3 (JIS-C) | 78 | 65 | 65 | 65 |
| Core | Diameter (mm) | 38.8 | 38.8 | 38.8 | 38.8 |
| | Hardness H4 (JIS-C) | 87 | 79 | 80 | 80 |
| | Difference H4 − H3 | 9 | 14 | 15 | 15 |
| | Difference H3 − H2 | 44 | 6 | 33 | 33 |
| | Difference H4 − H1 | 57 | 24 | 50 | 50 |
| | Deformation D2 | 3.55 | 3.60 | 3.55 | 3.55 |
| Mid layer | Composition | B | B | B | B |
| | Thickness (mm) | 1.0 | 1.0 | 1.0 | 1.0 |
| | Hardness H5 (Shore D) | 45 | 45 | 45 | 45 |
| Sphere *5 | Diameter (mm) | 40.8 | 40.8 | 40.8 | 40.8 |
| | Deformation D3 | 3.3 | 3.3 | 3.3 | 3.3 |
| Cover | Composition | (1) | (1) | (8) | (9) |
| | Flexural modulus (MPa) | 460 | 460 | 350 | 360 |
| | Tensile modulus (MPa) | 570 | 570 | 345 | 380 |
| | Thickness (mm) | 1.0 | 1.0 | 1.0 | 1.0 |
| | Hardness H6 (Shore D) | 67 | 67 | 64 | 64 |
| Ball | Deformation D4 (mm) | 3.00 | 3.00 | 3.00 | 3.00 |
| Initial speed (m/s) | | 57.9 | 58.4 | 58.2 | 58.2 |
| Spin rate (rpm) | | 2150 | 2330 | 2350 | 2350 |
| Flight distance (m) | | 204.5 | 205.0 | 204.0 | 204.0 |
| Durability | | 90 | 115 | 100 | 105 |

TABLE 8

| Results of Evaluation | | | | | | |
|---|---|---|---|---|---|---|
| | | Compara. Example 6 | Compara. Example 7 | Compara. Example 8 | Compara. Example 9 | Compara. Example 10 |
| Center | Composition | a | a | a | a | a |
| | Diameter (mm) | 10 | 10 | 10 | 10 | 10 |
| | Hardness H1 (JIS-C) | 30 | 30 | 30 | 30 | 30 |
| | Hardness H2 (JIS-C) | 32 | 32 | 32 | 32 | 32 |
| Envelope layer | Composition | e | f | f | f | f |
| | Thickness (mm) | 14.4 | 14.4 | 14.4 | 14.4 | 14.4 |
| | Hardness H3 (JIS-C) | 65 | 65 | 65 | 65 | 65 |
| Core | Diameter (mm) | 38.8 | 38.8 | 38.8 | 38.8 | 38.8 |
| | Hardness H4 (JIS-C) | 79 | 80 | 80 | 80 | 80 |
| | Difference H4 − H3 | 14 | 15 | 15 | 15 | 15 |
| | Difference H3 − H2 | 33 | 33 | 33 | 33 | 33 |
| | Difference H4 − H1 | 49 | 50 | 50 | 50 | 50 |
| | Deformation D2 | 3.65 | 3.55 | 3.55 | 3.55 | 3.55 |
| Mid layer | Composition | B | B | B | B | B |
| | Thickness (mm) | 1.0 | 1.0 | 1.0 | 1.0 | 1.0 |
| | Hardness H5 (Shore D) | 45 | 45 | 45 | 45 | 45 |
| Sphere *5 | Diameter (mm) | 40.8 | 40.8 | 40.8 | 40.8 | 40.8 |
| | Deformation D3 | 3.4 | 3.3 | 3.3 | 3.3 | 3.3 |
| Cover | Composition | (10) | (11) | (12) | (13) | (14) |
| | Flexural modulus (MPa) | 700 | 485 | 445 | 285 | 260 |
| | Tensile modulus (MPa) | 890 | 600 | 530 | 340 | 280 |
| | Thickness (mm) | 1.0 | 1.0 | 1.0 | 1.0 | 1.0 |
| | Hardness H6 (Shore D) | 76 | 68 | 68 | 63 | 63 |
| Ball | Deformation D4 (mm) | 3.00 | 3.00 | 3.00 | 3.00 | 3.00 |
| Initial speed (m/s) | | 58.2 | 58.4 | 58.4 | 58.3 | 58.3 |
| Spin rate (rpm) | | 2200 | 2250 | 2250 | 2350 | 2400 |
| Flight distance (m) | | 206.0 | 207.0 | 207.0 | 204.5 | 203.5 |
| Durability | | 95 | 90 | 95 | 125 | 95 |

As shown in Tables 4 to 8, the golf balls of Examples have excellent flight performance and excellent durability. From the results of evaluation, advantages of the present invention are clear.

[Experiment 2]

[Example 12]

A rubber composition (a) was obtained by kneading 50 parts by weight of a high-cis polybutadiene (trade name "BR-730", available from JSR Corporation), 50 parts by weight of a natural rubber (KR-7), 5 parts by weight of zinc oxide, an appropriate amount of a clay, 5 parts by weight of silica (trade name "Nipsil AQ", available from Tosoh Silica Corporation), 2.20 parts by weight of a sulfenamide type vulcanization accelerator (the aforementioned "Nocceler CZ"), 2.26 parts by weight of a guanidine type vulcanization accelerator (the aforementioned "Soxinol DG"), and 3.4 parts by weight of sulfur. The rubber composition (a) was placed into the mold shown in FIG. 3, to obtain a semi-crosslinked half shell. Ammonium chloride, sodium nitrite, and water were put into the half shell. A rubber cement in which the rubber composition (a) was dissolved in a solvent was applied to a joining surface of the half shell. The half shell was fitted with another half shell. These half shells were placed into a mold that included upper and lower mold halves each having a hemispherical cavity, and heated at 150° C. for 5 minutes to obtain a hollow center with an inner diameter of 3.0 mm and an outer diameter of 5.0 mm.

A rubber composition (e) was obtained by kneading 100 parts by weight of a high-cis polybutadiene (the aforementioned "BR-730"), 28 parts by weight of zinc diacrylate, 5 parts by weight of zinc oxide, an appropriate amount of barium sulfate, 0.5 part by weight of bis(pentabromophenyl) disulfide, and 0.7 part by weight of dicumyl peroxide. Two half shells were formed from the rubber composition (e). The center was covered with the two half shells. The center and the half shells were placed into a mold that included upper and lower mold halves each having a hemispherical cavity, and heated at 170° C. for 20 minutes to obtain a core with a diameter of 38.2 mm. The amount of barium sulfate was adjusted such that the specific gravity of an envelope layer agreed with the specific gravity of the center and the weight of a golf ball was 45.6 g.

A resin composition (A) was obtained by kneading 26 parts by weight of a sodium-neutralized ionomer resin (the aforementioned "Surlyn 8945"), 26 parts by weight of a zinc-neutralized ionomer resin (the aforementioned "Himilan AM7329"), 48 parts by weight of a styrene block-containing thermoplastic elastomer (the aforementioned "Rabalon T3221C"), and 3 parts by weight of titanium dioxide with a twin-screw kneading extruder. The core was placed into a mold that included upper and lower mold halves each having a hemispherical cavity. The core was covered with the resin composition (A) by injection molding to form a mid layer with a thickness of 1.0 mm.

A resin composition (1) was obtained by kneading 30 parts by weight of a highly elastic polyamide (the aforementioned "Novamid ST220"), 30 parts by weight of a sodium-neutralized ionomer resin (an ethylene-(meth)acrylic acid copolymer, the aforementioned "Surlyn 8945"), 40 parts by weight of a zinc-neutralized ionomer resin (an ethylene-(meth) acrylic acid copolymer, the aforementioned "Himilan AM7329"), 5 parts by weight of a resin having a polar functional group (the aforementioned "LOTARDER AX8840"), and 3 parts by weight of titanium dioxide with a twin-screw kneading extruder. The sphere that included the mid layer was placed into a final mold that included upper and lower mold halves each having a hemispherical cavity and that had a large number of pimples on its cavity face. The sphere was covered with the resin composition (1) by injection molding to form a cover with a thickness of 1.3 mm. A large number of dimples having a shape that was the inverted shape of the pimples were formed on the cover. A clear paint that included a two-component curing type polyurethane as a base material was applied to the cover to obtain a golf ball of Example 12 with a diameter of 42.8 mm and a weight of 45.6 g.

[Examples 13 to 21 and Comparative Examples 11 to 20]

Golf balls of Examples 13 to 21 and Comparative Examples 11 to 20 were obtained in a similar manner as Example 12, except the specifications of the center, the envelope layer, the mid layer, and the cover were as shown in the following Tables 12 to 16. The rubber compositions of the center and the envelope layer are shown in detail in the following Table 9. The resin composition of the mid layer is shown in detail in the following Table 10. The resin composition of the cover is shown in detail in the following Table 11. The golf ball of Comparative Example 11 does not have an envelope layer. The center of the golf ball of Comparative Example 12 does not have a space.

[Shot with Driver (W#1)]

A driver with a titanium head (trade name "XXIO", available from SRI Sports Limited, shaft hardness: R, loft angle: 11.0°) was attached to a swing machine available from Golf Laboratories, Inc. A golf ball was hit under the condition of a head speed of 40 m/sec, and the distance from the launch point to the stop point was measured. In addition, the ball speed and the backspin rate were measured immediately after the hit. The average value of data obtained by 12 measurements is shown in the following Tables 12 to 16.

[Durability]

A driver with a titanium head was attached to a swing machine available from Golf Laboratories, Inc. A golf ball was hit under the condition of a head speed of 45 m/sec. This hitting was repeated, and the number of hits required to break the golf ball was counted. The average value of data obtained by 6 measurements is shown as an index in the following Tables 12 to 16. It is noted that when the cover was not broken and the core or the mid layer was broken, the breakage was recognized by the hitting sound or the shape of the golf ball.

TABLE 9

Compositions of Center and Envelope Layer (parts by weight)

| | a | b | c | d | e | f | g | h |
|---|---|---|---|---|---|---|---|---|
| Polybutadiene | 50 | 50 | 50 | 100 | 100 | 100 | 100 | 100 |
| Natural rubber | 50 | 50 | 50 | — | — | — | — | — |
| Zinc diacrylate | — | — | — | 15 | 28 | 29 | 33 | 40 |
| Zinc oxide | 5 | 5 | 5 | 5 | 5 | 5 | 5 | 5 |
| Barium sulfate | — | — | — | *1 | *1 | *1 | *1 | *1 |
| Clay | *1 | *1 | *1 | — | — | — | — | — |
| Silica | 5 | 7 | 10 | — | — | — | — | — |
| Diphenyl disulfide | — | — | — | 0.5 | — | — | — | — |
| Bis(pentabromophenyl)disulfide | — | — | — | — | 0.5 | 0.5 | 0.5 | 0.5 |
| Dicumyl peroxide | — | — | — | 0.7 | 0.7 | 0.7 | 0.7 | 0.7 |
| Vulcanization accelerator CZ | 2.20 | 2.20 | 2.20 | — | — | — | — | — |
| Vulcanization accelerator DG | 2.26 | 2.26 | 2.26 | — | — | — | — | — |
| Sulfur | 3.4 | 3.4 | 3.4 | — | — | — | — | — |

*1 Appropriate amount

TABLE 10

Composition of Mid Layer (parts by weight)

| | A | B | C | D |
|---|---|---|---|---|
| Surlyn 8945 | 26 | 30 | 35 | 39 |
| Himilan AM7329 | 26 | 30 | 34 | 38 |
| Rabalon T3221C | 48 | 40 | 31 | 23 |
| Titanium dioxide | 3 | 3 | 3 | 3 |
| Hardness H5 (Shore D) | 35 | 40 | 45 | 50 |

TABLE 11

Composition of Cover (parts by weight)

| | (1) | (2) | (3) | (4) | (5) | (6) | (7) | (8) | (9) | (10) | (11) | (12) | (13) | (14) |
|---|---|---|---|---|---|---|---|---|---|---|---|---|---|---|
| (A) Novamid ST220 *2 | 30 | 10 | 70 | 30 | 30 | 30 | — | — | 3 | 85 | 30 | 30 | 30 | — |
| (A) Amilan U141 *3 | — | — | — | — | — | — | 60 | — | — | — | — | — | — | — |
| (B) Surlyn 8945 | 30 | 40 | 15 | 30 | 30 | 30 | 20 | 40 | 40 | 5 | 30 | 30 | 30 | 45 |
| (B) Himilan AM7329 | 40 | 50 | 15 | 40 | 40 | 40 | 20 | 60 | 57 | 10 | 40 | 40 | 40 | 45 |
| (C) LOTARDER AX8840 | 5 | 5 | 5 | 3 | 1 | 15 | 5 | — | 5 | 5 | — | 0.05 | 25 | 5 |
| (C) ARUFON UG-4030 | — | — | — | 2 | — | — | — | — | — | — | — | — | — | — |
| Pebax 4033SA *4 | — | — | — | — | — | — | — | — | — | — | — | — | — | 10 |

TABLE 11-continued

| Composition of Cover | | | | | | | | | | | | | | (parts by weight) |
|---|---|---|---|---|---|---|---|---|---|---|---|---|---|---|
| | (1) | (2) | (3) | (4) | (5) | (6) | (7) | (8) | (9) | (10) | (11) | (12) | (13) | (14) |
| Titanium dioxide | 3 | 3 | 3 | 3 | 3 | 3 | 3 | 3 | 3 | 3 | 3 | 3 | 3 | 3 |
| Hardness H6 (Shore D) | 67 | 66 | 73 | 68 | 68 | 65 | 70 | 64 | 64 | 76 | 68 | 68 | 63 | 63 |
| Flexural modulus (MPa) | 460 | 365 | 530 | 480 | 450 | 360 | 495 | 350 | 360 | 700 | 485 | 445 | 285 | 260 |
| Tensile modulus (MPa) | 570 | 420 | 875 | 590 | 545 | 430 | 620 | 345 | 380 | 890 | 600 | 530 | 340 | 280 |

*2 Flexural modulus: 2000 MPa

*3 Flexural modulus: 1500 MPa

*4 Thermoplastic polyamide elastomer available from Arkema Inc., flexural modulus: 84 MPa

TABLE 12

| Results of Evaluation | | | | | |
|---|---|---|---|---|---|
| | | Example 12 | Example 13 | Example 14 | Example 15 |
| Center | Composition | a | b | c | c |
| | Inner diameter (mm) | 3.0 | 4.0 | 5.0 | 8.0 |
| | Outer diameter (mm) | 5.0 | 7.0 | 10.0 | 14.4 |
| | Hardness H1 (JIS-C) | 27 | 29 | 32 | 32 |
| | Hardness H2 (JIS-C) | 30 | 32 | 37 | 37 |
| Envelope layer | Composition | e | e | f | g |
| | Thickness (mm) | 16.6 | 15.7 | 14.4 | 12.5 |
| | Hardness H3 (JIS-C) | 63 | 64 | 65 | 67 |
| Core | Diameter (mm) | 38.2 | 38.4 | 38.8 | 39.4 |
| | Hardness H4 (JIS-C) | 79 | 79 | 80 | 81 |
| | Difference H4 − H3 | 16 | 15 | 15 | 14 |
| | Difference H3 − H2 | 33 | 32 | 28 | 30 |
| | Difference H4 − H2 | 49 | 47 | 43 | 44 |
| | Deformation D2 | 3.70 | 3.70 | 3.65 | 3.58 |
| Mid layer | Composition | A | B | C | D |
| | Thickness (mm) | 1.0 | 1.0 | 1.0 | 1.0 |
| | Hardness H5 (Shore D) | 35 | 40 | 45 | 50 |
| Sphere *5 | Diameter (mm) | 40.2 | 40.4 | 40.8 | 41.4 |
| | Deformation D3 | 3.50 | 3.48 | 3.40 | 3.35 |
| Cover | Composition | (1) | (1) | (1) | (1) |
| | Flexural modulus (MPa) | 460 | 460 | 460 | 460 |
| | Tensile modulus (MPa) | 570 | 570 | 570 | 570 |
| | Thickness (mm) | 1.3 | 1.2 | 1.0 | 0.7 |
| | Hardness H6 (Shore D) | 67 | 67 | 67 | 67 |
| Ball | Deformation D4 (mm) | 3.10 | 3.10 | 3.10 | 3.10 |
| Initial speed (m/s) | | 58.3 | 58.3 | 58.3 | 58.3 |
| Spin rate (rpm) | | 2250 | 2220 | 2200 | 2150 |
| Flight distance (m) | | 206.0 | 206.5 | 207.0 | 207.5 |
| Durability | | 120 | 115 | 110 | 105 |

*5 Sphere consisting of a core and a mid layer

TABLE 13

| Results of Evaluation | | | | | |
|---|---|---|---|---|---|
| | | Example 16 | Example 17 | Example 18 | Example 19 |
| Center | Composition | c | c | c | c |
| | Inner diameter (mm) | 5.0 | 5.0 | 5.0 | 5.0 |
| | Outer diameter (mm) | 10.0 | 10.0 | 10.0 | 10.0 |
| | Hardness H1 (JIS-C) | 32 | 32 | 32 | 32 |
| | Hardness H2 (JIS-C) | 37 | 37 | 37 | 37 |
| Envelope layer | Composition | f | f | f | f |
| | Thickness (mm) | 14.4 | 14.4 | 14.4 | 14.4 |
| | Hardness H3 (JIS-C) | 65 | 65 | 65 | 65 |
| Core | Diameter (mm) | 38.8 | 38.8 | 38.8 | 38.8 |
| | Hardness H4 (JIS-C) | 80 | 80 | 80 | 80 |
| | Difference H4 − H3 | 15 | 15 | 15 | 15 |
| | Difference H3 − H2 | 28 | 28 | 28 | 28 |
| | Difference H4 − H2 | 43 | 43 | 43 | 43 |
| | Deformation D2 | 3.65 | 3.65 | 3.65 | 3.65 |
| Mid layer | Composition | C | C | C | C |
| | Thickness (mm) | 1.0 | 1.0 | 1.0 | 1.0 |
| | Hardness H5 (Shore D) | 45 | 45 | 45 | 45 |

TABLE 13-continued

| Results of Evaluation | | | | | |
|---|---|---|---|---|---|
| | | Example 16 | Example 17 | Example 18 | Example 19 |
| Sphere *5 | Diameter (mm) | 40.8 | 40.8 | 40.8 | 40.8 |
| | Deformation D3 | 3.40 | 3.40 | 3.40 | 3.40 |
| Cover | Composition | (2) | (3) | (4) | (5) |
| | Flexural modulus (MPa) | 365 | 530 | 480 | 450 |
| | Tensile modulus (MPa) | 420 | 875 | 590 | 545 |
| | Thickness (mm) | 1.0 | 1.0 | 1.0 | 1.0 |
| | Hardness H6 (Shore D) | 66 | 73 | 68 | 68 |
| Ball | Deformation D4 (mm) | 3.10 | 3.10 | 3.10 | 3.10 |
| Initial speed (m/s) | | 58.3 | 58.2 | 58.3 | 58.3 |
| Spin rate (rpm) | | 2220 | 2160 | 2190 | 2200 |
| Flight distance (m) | | 206.5 | 206.5 | 207.0 | 207.0 |
| Durability | | 125 | 110 | 120 | 105 |

TABLE 14

| Results of Evaluation | | | | | |
|---|---|---|---|---|---|
| | | Example 20 | Example 21 | Compara. Example 11 | Compara. Example 12 |
| Center | Composition | c | c | e | d |
| | Inner diameter (mm) | 5.0 | 5.0 | — | — |
| | Outer diameter (mm) | 10.0 | 10.0 | 38.2 | 7.0 |
| | Hardness H1 (JIS-C) | 32 | 32 | 62 *6 | 55 *6 |
| | Hardness H2 (JIS-C) | 37 | 37 | 79 | 61 |
| Envelope layer | Composition | f | f | — | e |
| | Thickness (mm) | 14.4 | 14.4 | — | 15.7 |
| | Hardness H3 (JIS-C) | 65 | 65 | — | 64 |
| Core | Diameter (mm) | 38.8 | 38.8 | 38.8 | 38.4 |
| | Hardness H4 (JIS-C) | 80 | 80 | 79 (H2) | 79 |
| | Difference H4 − H3 | 15 | 15 | — | 15 |
| | Difference H3 − H2 | 28 | 28 | — | 3 |
| | Difference H4 − H2 | 43 | 43 | — | 18 |
| | Deformation D2 | 3.65 | 3.65 | 3.60 | 3.65 |
| Mid layer | Composition | C | C | A | B |
| | Thickness (mm) | 1.0 | 1.0 | 1.0 | 1.0 |
| | Hardness H5 (Shore D) | 45 | 45 | 35 | 40 |
| Sphere *5 | Diameter (mm) | 40.8 | 40.8 | 40.8 | 40.4 |
| | Deformation D3 | 3.40 | 3.40 | 3.40 | 3.45 |
| Cover | Composition | (6) | (7) | (1) | (1) |
| | Flexural modulus (MPa) | 360 | 495 | 460 | 460 |
| | Tensile modulus (MPa) | 430 | 620 | 570 | 570 |
| | Thickness (mm) | 1.0 | 1.0 | 1.0 | 1.2 |
| | Hardness H6 (Shore D) | 65 | 70 | 67 | 67 |
| Ball | Deformation D4 (mm) | 3.10 | 3.10 | 3.10 | 3.10 |
| Initial speed (m/s) | | 58.3 | 58.3 | 58.3 | 58.3 |
| Spin rate (rpm) | | 2500 | 2150 | 2350 | 2300 |
| Flight distance (m) | | 206.0 | 207.5 | 205.0 | 205.0 |
| Durability | | 115 | 130 | 125 | 115 |

*6 Central hardness

TABLE 15

| Results of Evaluation | | | | | |
|---|---|---|---|---|---|
| | | Compara. Example 13 | Compara. Example 14 | Compara. Example 15 | Compara. Example 16 |
| Center | Composition | c | c | c | c |
| | Inner diameter (mm) | 14.0 | 5.0 | 5.0 | 5.0 |
| | Outer diameter (mm) | 20.0 | 10.0 | 10.0 | 10.0 |
| | Hardness H1 (JIS-C) | 35 | 32 | 32 | 32 |
| | Hardness H2 (JIS-C) | 41 | 37 | 37 | 37 |
| Envelope layer | Composition | h | f | f | f |
| | Thickness (mm) | 9.4 | 14.4 | 14.4 | 14.4 |
| | Hardness H3 (JIS-C) | 78 | 65 | 65 | 65 |
| Core | Diameter (mm) | 38.8 | 38.8 | 38.8 | 38.8 |
| | Hardness H4 (JIS-C) | 87 | 80 | 80 | 80 |

TABLE 15-continued

| Results of Evaluation | | | | | |
|---|---|---|---|---|---|
| | | Compara. Example 13 | Compara. Example 14 | Compara. Example 15 | Compara. Example 16 |
| | Difference H4 – H3 | 9 | 15 | 15 | 15 |
| | Difference H3 – H2 | 37 | 28 | 28 | 28 |
| | Difference H4 – H2 | 46 | 43 | 43 | 43 |
| | Deformation D2 | 3.65 | 3.65 | 3.65 | 3.65 |
| Mid layer | Composition | C | C | C | C |
| | Thickness (mm) | 1.0 | 1.0 | 1.0 | 1.0 |
| | Hardness H5 (Shore D) | 45 | 45 | 45 | 45 |
| Sphere *5 | Diameter (mm) | 40.8 | 40.8 | 40.8 | 40.8 |
| | Deformation D3 | 3.40 | 3.40 | 3.40 | 3.40 |
| Cover | Composition | (1) | (8) | (9) | (10) |
| | Flexural modulus (MPa) | 460 | 350 | 360 | 700 |
| | Tensile modulus (MPa) | 570 | 345 | 380 | 890 |
| | Thickness (mm) | 1.0 | 1.0 | 1.0 | 1.0 |
| | Hardness H6 (Shore D) | 67 | 64 | 64 | 76 |
| Ball | Deformation D4 (mm) | 3.10 | 3.10 | 3.10 | 3.10 |
| Initial speed (m/s) | | 57.8 | 58.1 | 58.1 | 58.1 |
| Spin rate (rpm) | | 2100 | 2300 | 2300 | 2150 |
| Flight distance (m) | | 204.5 | 204.0 | 204.0 | 206.0 |
| Durability | | 90 | 100 | 105 | 95 |

TABLE 16

| Results of Evaluation | | | | | |
|---|---|---|---|---|---|
| | | Compara. Example 17 | Compara. Example 18 | Compara. Example 19 | Compara. Example 20 |
| Center | Composition | c | c | c | c |
| | Inner diameter (mm) | 5.0 | 5.0 | 5.0 | 5.0 |
| | Outer diameter (mm) | 10.0 | 10.0 | 10.0 | 10.0 |
| | Hardness H1 (JIS-C) | 32 | 32 | 32 | 32 |
| | Hardness H2 (JIS-C) | 37 | 37 | 37 | 37 |
| Envelope layer | Composition | f | f | f | f |
| | Thickness (mm) | 14.4 | 14.4 | 14.4 | 14.4 |
| | Hardness H3 (JIS-C) | 65 | 65 | 65 | 65 |
| Core | Diameter (mm) | 38.8 | 38.8 | 38.8 | 38.8 |
| | Hardness H4 (JIS-C) | 80 | 80 | 80 | 80 |
| | Difference H4 – H3 | 15 | 15 | 15 | 15 |
| | Difference H3 – H2 | 28 | 28 | 28 | 28 |
| | Difference H4 – H2 | 43 | 43 | 43 | 43 |
| | Deformation D2 | 3.65 | 3.65 | 3.65 | 3.65 |
| Mid layer | Composition | C | C | C | C |
| | Thickness (mm) | 1.0 | 1.0 | 1.0 | 1.0 |
| | Hardness H5 (Shore D) | 45 | 45 | 45 | 45 |
| Sphere *5 | Diameter (mm) | 40.8 | 40.8 | 40.8 | 40.8 |
| | Deformation D3 | 3.40 | 3.40 | 3.40 | 3.40 |
| Cover | Composition | (11) | (12) | (13) | (14) |
| | Flexural modulus (MPa) | 485 | 445 | 285 | 260 |
| | Tensile modulus (MPa) | 600 | 530 | 340 | 280 |
| | Thickness (mm) | 1.0 | 1.0 | 1.0 | 1.0 |
| | Hardness H6 (Shore D) | 68 | 68 | 63 | 63 |
| Ball | Deformation D4 (mm) | 3.10 | 3.10 | 3.10 | 3.10 |
| Initial speed (m/s) | | 58.3 | 58.3 | 58.2 | 58.2 |
| Spin rate (rpm) | | 2200 | 2200 | 2300 | 2350 |
| Flight distance (m) | | 207.0 | 207.0 | 204.5 | 203.5 |
| Durability | | 90 | 95 | 125 | 95 |

As shown in Tables 12 to 16, the golf balls of Examples have excellent flight performance. From the results of evaluation, advantages of the present invention are clear.

The golf ball according to the present invention can be used for playing golf on a golf course and practicing at a driving range. The above description is merely for illustrative examples, and various modifications can be made without departing from the principles of the present invention.

What is claimed is:

1. A golf ball comprising a core and a cover positioned outside the core, wherein the core includes a center and an envelope layer positioned outside the center, the center has a diameter of 1 mm or greater and 15 mm or less, the center has a JIS-C hardness H1, at its central point, of 20 or greater and 50 or less, a difference (H4-H3) between a JIS-C hardness H4 of the core at its surface and a JIS-C hardness H3 of the envelope layer at its innermost portion is equal to or greater than 10, the cover has a flexural modulus of 300 MPa or greater and 1000 MPa or less, the cover has a tensile modulus of 400 MPa or greater and 1500 MPa or less, and the cover is formed from a resin composition that includes:

(A) a highly elastic polyamide resin with a flexural modulus of 700 MPa or greater and 5000 MPa or less, (B) an ethylene-(meth)acrylic acid copolymer that is neutralized with a metal ion, and (C) a resin having a polar functional group, a weight ratio of the polyamide resin (A) with respect to the copolymer (B) is equal to or greater than 5/95 and equal to or less than 80/20, wherein the amount of the resin (C) is equal to or greater than 0.1 part by weight and equal to or less than 20 parts by weight, per total 100 parts by weight of the polyamide resin (A) and the copolymer (B).

2. The golf ball according to claim 1, wherein the cover has a Shore D hardness H6 of 65 or greater and 75 or less.

3. The golf ball according to claim 1, wherein the polyamide resin (A) includes one or more members selected from the group consisting of polyamide 6, polyamide 11, polyamide 12, polyamide 66, polyamide 610, polyamide 6T, polyamide 6I, polyamide 9T, polyamide MST, polyamide 612, and a polyether block amide copolymer.

4. The golf ball according to claim 1, wherein the copolymer (B) includes an ethylene-(meth)acrylic acid binary copolymer and/or an ethylene-(meth) acrylic acid-(meth) acrylic acid ester ternary copolymer.

5. The golf ball according to claim 1, wherein the resin (C) includes one or more members selected from the group consisting of an ethylene-glycidyl methacrylate copolymer, an ethylene-acrylic acid-glycidyl methacrylate copolymer, and a methyl methacrylate-glycidyl methacrylate copolymer.

6. The golf ball according to claim 1, further comprising a mid layer positioned between the core and the cover, wherein a shore D hardness H6 of the cover is greater than a Shore D hardness H5 of the mid layer.

7. The golf ball according to claim 6, wherein the mid layer is formed from a thermoplastic resin composition.

8. The golf ball according to claim 1, wherein a difference (H3-H2) between the hardness H3 and a JIS-C hardness H2 of the center at its surface is equal to or less than 35.

9. The golf ball according to claim 1, wherein the difference (H4-H1) between the hardness H4 and the hardness H1 is equal to or greater than 40.

10. The golf ball according to claim 1, wherein the center is formed by crosslinking a rubber composition, the principal component of the base rubber of the rubber composition is a polybutadiene, and the rubber composition includes sulfur as a crosslinking agent.

11. The golf ball according to claim 1, wherein the envelope layer is formed by crosslinking a rubber composition, and the principal component of the base rubber of the rubber composition is a polybutadiene.

* * * * *